US008536088B2

(12) United States Patent
Murakami et al.

(10) Patent No.: US 8,536,088 B2
(45) Date of Patent: Sep. 17, 2013

(54) METHOD AND APPARATUS FOR FORMING IMAGE, SURFACE-PROPERTY-MODIFYING SHEET, AND THERMAL TRANSFER SHEET

(75) Inventors: Takaaki Murakami, Kanagawa (JP); Ken Higuchi, Kanagawa (JP); Yasushi Hirumi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1455 days.

(21) Appl. No.: 12/177,981

(22) Filed: Jul. 23, 2008

(65) Prior Publication Data

US 2009/0035493 A1 Feb. 5, 2009

(30) Foreign Application Priority Data

Aug. 3, 2007 (JP) ..... 2007-203305
Jan. 17, 2008 (JP) ..... 2008-007628

(51) Int. Cl.
*B41M 5/382* (2006.01)

(52) U.S. Cl.
USPC ..... 503/227

(58) Field of Classification Search
None
See application file for complete search history.

(56) References Cited

U.S. PATENT DOCUMENTS 5,496,072 A 3/1996 Yamauchi
5,956,067 A 9/1999 Isono
6,121,987 A 9/2000 Sasaki
2005/0064319 A1 3/2005 Simpson
2005/0064320 A1 3/2005 Simpson

FOREIGN PATENT DOCUMENTS

JP 62-170376 7/1987
JP 2004-188694 7/2004
JP 2007-076332 3/2007

OTHER PUBLICATIONS

Japanese Office Action issued on Feb. 21, 2012, in connection with counterpart JP Application No. 2008-007628.
European Search Report corresponding to European Serial No. 08012045.5 dated Aug. 11, 2010.

*Primary Examiner* — Bruce H Hess
(74) *Attorney, Agent, or Firm* — Dentons US LLP

(57) ABSTRACT

In an image-forming method, a ribbon-shaped thermal transfer sheet with a dye layer and a protective material layer arranged side-by-side in the longitudinal direction is moved, and thermal energy is applied from a thermal head while arranging a recording medium to face the dye layer to thermally transfer the dye layer onto the recording medium to form an image. Thermal energy is applied while arranging the image to face the protective material layer to thereby form a protective layer on the image by thermal transfer. A ribbon-shaped surface-property-modifying sheet including a surface-property-modifying region for modifying the surface of the protective layer is moved, and the protective layer is aligned with the surface-property-modifying region of the surface-property-modifying sheet. Heat and pressure are applied from the thermal head and the surface-property-modifying sheet is detached after cooling to modify the surface condition of the protective layer.

10 Claims, 15 Drawing Sheets

METHOD AND APPARATUS FOR FORMING IMAGE, SURFACE-PROPERTY-MODIFYING SHEET, AND THERMAL TRANSFER SHEET

CROSS REFERENCES TO RELATED APPLICATIONS

The present invention contains subject matter related to Japanese Patent Application JP 2007-203305 filed in the Japanese Patent Office on Aug. 3, 2007, and Japanese Patent Application JP 2008-007628 filed in the Japanese Patent Office on Jan. 17, 2008 the entire contents of which are incorporated herein by reference.

BACKGROUND OF THE INVENTION

1. Field of the Invention

The present invention relates to image-forming methods and apparatuses in which surfaces of images recorded on recording media by using thermal transfer sheets are protected with protective layers formed thereon. In particular, the present invention relates to an image-forming method and an image-forming apparatus in which the surface condition of the protective layer formed over the image on the recording medium is modified to give a glossy, matte, or embossed texture, and to a surface-property-modifying sheet and a thermal transfer sheet used in the method and apparatus.

2. Description of the Related Art

Dye-sublimation-type image forming apparatuses that form images by transferring dye layers of thermal transfer sheets onto recording media have been available. In using this type of apparatus, a transparent protective layer is formed on an image formed on the recording medium to protect the surface of the image. In particular, the protective layer functions as a barrier for isolating the image from gas that causes deterioration, absorbs UV rays to prevent discoloration and fading of the image, prevents the dye or the like forming the image from migrating to other products, such as erasers, containing various plasticizers, and protects the image from sebum.

The protective layer is, for example, laminated on a ribbon-shaped substrate sheet and thermally transferred onto the image by using a thermal head. Thermal transfer of the protective layer onto the image not only helps protect the image and but also prevents the recording medium from curling or from undergoing other similar phenomena. During the thermal transfer using the thermal head, the thermal energy from the thermal head may be adequately changed to form a pattern of microscopic asperities so that the surface of the protective layer is glossy, matte, or embossed as desired.

In an existing image-forming apparatus such as one disclosed in Japanese Unexamined Patent Application Publication No. 2007-76332, a recording medium constituted by a thermoplastic substrate and a receiving layer that receives a dye is fed; a thermal transfer sheet is made to travel, the thermal transfer sheet having a dye layer and a protective layer aligned side-by-side in the travelling direction; thermal energy is applied from the thermal head while arranging the receiving layer of the recording medium to oppose the dye layer of the thermal transfer sheet so that an image is formed by heat transfer of the dye layer of the thermal transfer sheet onto the receiving layer of the recording medium; thermal energy is again applied from the thermal head while arranging the image formed on the recording medium to oppose the protective layer of the thermal transfer sheet so as to thermally transfer the protective layer of the thermal transfer sheet onto the image formed on the recording medium.

SUMMARY OF THE INVENTION

The existing image-forming apparatus described above uses a thermal transfer sheet integrated with the protective layer. Thus, the dye layer for forming images is either directly formed on the substrate sheet or on an adhesion layer for stabilizing adhesion disposed on the substrate sheet. Moreover, the rear side (side opposite the side in which the dye layer is formed) of the substrate sheet is usually provided with a heat-resistant lubricating layer mainly for ensuring stable travelling of the thermal transfer sheet by decreasing the friction between the thermal head and the thermal transfer sheet during printing.

The protective layer for protecting the image is formed on a detachment layer on the adhesion layer on the substrate sheet so that the protective layer can be smoothly thermally transferred onto the recording medium. During transfer of the protective layer onto the recording medium, detachment occurs at the interface between the detachment layer and protective layer so that the detachment layer remains on the thermal transfer sheet side and only the protective layer is thermally transferred onto the recording medium to protect the printed image. The combination of materials of the protective layer and the detachment layer is selected such that detachment easily occurs at the interface. During transfer of the protective layer from the thermal transfer sheet to the recording medium, interfacial detachment occurs between the protective layer and the detachment layer. Thus, the image formed on the recording medium has a protective layer on the top thereof. Since the surface of the protective layer is smooth and flat to a certain extent, the printed image has a certain degree of glossiness.

However, since the detachment layer for detaching the protective layer is formed by applying a resin on the adhesion layer on the substrate and then drying the applied resin, the detachment layer does not have satisfactory smoothness. The smoothness of the detached surface of the protective layer transferred from the thermal transfer sheet is affected by the smoothness of the surface of the detachment layer. Accordingly, the smoothness of the surface of the protective layer on the top of the printed image is not sufficiently high. Thus, the glossiness of the printed image obtained with the existing image-forming apparatus is not satisfactory and is inferior to the glossiness of general photographs taken with film cameras. In the case where natural images are printed, such as color images, there are also requirements for various different types of surface finish of the printed images, such as a matte finish and an embossed finish in addition to the glossy finish.

It is desirable to provide an image-forming method and an image-forming apparatus that overcome the above-described weakness so that the surface condition of the protective layer over the image on the recording medium is modified to give a glossy, matte, or embossed surface, and to provide a surface-property-modifying sheet and a thermal transfer sheet for use in the method and apparatus.

An embodiment of the present invention provides a method for forming an image, including the steps of (a) conveying a recording medium in a particular direction; (b) moving a thermal transfer sheet in a particular direction, the thermal transfer sheet including a first ribbon-shaped substrate sheet, a dye layer for forming an image by being thermally transferred onto a surface of the recording medium, and a protective material layer for forming a protective layer for protecting the image by being thermally transferred onto the surface of the image formed on the surface of the recording medium, the dye layer and the protective material layer being arranged side-by-side on the first ribbon-shaped substrate sheet in a longitudinal direction of the first ribbon-shaped substrate sheet; (c) applying thermal energy by using a thermal head while arranging the recording medium to face the dye layer of the thermal transfer sheet so as to thermally transfer the dye layer of the thermal transfer sheet onto the surface of the recording medium to form an image; (d) applying thermal energy by using the thermal head while arranging the image formed on the recording medium to face the protective material layer of the thermal transfer sheet so as to thermally transfer the protective material layer of the thermal transfer sheet onto the image formed on the recording medium and to thereby form a protective layer on the image; (e) moving a surface-property-modifying sheet including a second ribbon-shaped substrate sheet and a surface-property-modifying region for modifying a surface condition of the protective layer protecting the image formed on the recording medium, the surface-property-modifying region being arranged on the second ribbon-shaped substrate sheet in the longitudinal direction of the second ribbon-shaped substrate sheet; and (f) aligning the protective layer formed on the image on the recording medium with the surface-property-modifying region of the surface-property-modifying sheet, applying heat and pressure by using the thermal head, and detaching the surface-property-modifying sheet after cooling so as to modify the surface condition of the protective layer.

According to this method, a recording medium is conveyed in a particular direction; a thermal transfer sheet is moved in a particular direction, the thermal transfer sheet including a first ribbon-shaped substrate sheet, a dye layer for forming an image by being thermally transferred onto a surface of the recording medium, and a protective material layer for protecting the image by being thermally transferred onto the surface of the image formed on the surface of the recording medium, the dye layer and the protective layer being arranged side-by-side on the first ribbon-shaped substrate sheet in a longitudinal direction of the first ribbon-shaped substrate sheet; thermal energy is applied by using a thermal head while arranging the recording medium to face the dye layer of the thermal transfer sheet so as to thermally transfer the dye layer of the thermal transfer sheet onto the surface of the recording medium to form an image; applying thermal energy is applied by using the thermal head while arranging the image formed on the recording medium to face the protective material layer of the thermal transfer sheet so as to thermally transfer the protective material layer of the thermal transfer sheet onto the image formed on the recording medium and to thereby form a protective layer on the image; a surface-property-modifying sheet is moved, the surface-property-modifying sheet including a second ribbon-shaped substrate sheet and a surface-property-modifying region for modifying a surface condition of the protective layer protecting the image formed on the recording medium, the surface-property-modifying region being arranged on the second ribbon-shaped substrate sheet in the longitudinal direction of the second ribbon-shaped substrate sheet; and the protective layer formed on the image on the recording medium is aligned with the surface-property-modifying region of the surface-property-modifying sheet, applying heat and pressure by using the thermal head, and detaching the surface-property-modifying sheet after cooling so as to modify the surface condition of the protective layer. Thus, depending on the type of the surface-property-modifying region of the surface-property-modifying sheet, the surface condition of the protective layer can be imparted a glossy, matte, or embossed texture so as to modify the surface condition of the printed image.

In the method described above, preferably, the surface-property-modifying sheet has an opening for printing that allows the thermal transfer sheet to directly contact the surface of the recording medium, and, in forming the image, the opening is aligned with the thermal head so that the thermal transfer sheet directly contacts the recording medium through the opening to form the image.

In heating the surface-property-modifying region of the surface-property-modifying sheet by using the thermal head, heating may be performed at a temperature near a glass transition temperature of the protective material layer of the thermal transfer sheet. In this manner, since the protective layer protecting image on the recording medium softens moderately and closely adheres to the surface-property-modifying region. Thus, the surface condition of the protective layer can be modified according to the surface condition of the contact surface of the surface-property-modifying region.

The modification of the surface condition of the protective layer formed on the image on the recording medium may involve imparting glossiness to the surface of the protective layer. In this manner, a printed image with excellent surface glossiness can be obtained.

The modification of the surface condition of the protective layer formed on the image on the recording medium may involve imparting a matte or embossed texture to the surface of the protective layer. In this manner, a printed image with a matte or embossed finish can be obtained.

Another embodiment provides an image-forming apparatus that includes conveying means for conveying a recording medium in a particular direction; thermal transfer sheet-moving means for moving a thermal transfer sheet in a particular direction, the thermal transfer sheet including a first ribbon-shaped substrate sheet, a dye layer for forming an image by being thermally transferred onto a surface of the recording medium, and a protective material layer for forming a protective layer protecting the image by being thermally transferred onto the surface of the image formed on the surface of the recording medium, the dye layer and the protective material layer being arranged side-by-side on the first ribbon-shaped substrate sheet in a longitudinal direction of the first ribbon-shaped substrate sheet; modifying sheet-moving means for moving a surface-property-modifying sheet that includes a second ribbon-shaped substrate sheet having an opening for printing that allows the thermal transfer sheet to directly contact the surface of the recording medium and a surface-property-modifying region for modifying a surface condition of the protective layer protecting the image formed on the recording medium, the opening and the surface-property-modifying region being arranged side by side on the second ribbon-shaped substrate sheet in a longitudinal direction of the second ribbon-shaped substrate sheet; and a thermal head for applying thermal energy while arranging the recording medium to face the dye layer or the protective material layer of the thermal transfer sheet so as to thermally transfer the dye layer and the protective material layer sequentially onto the surface of the recording medium. In this apparatus, after the image is formed on the recording medium and the protective layer for protecting the image is formed on the image by using the thermal transfer sheet, the surface-property-modifying region of the surface-property-modifying sheet is aligned with the surface of the recording medium where the protective layer is formed and heat and pressure are applied from the thermal head to modify the surface condition of the protective layer formed on the recording medium. Thus, depending on the type of the surface-property-modifying region of the surface-property-modifying sheet, the surface condition of the protective layer can be imparted a glossy, matte, or embossed texture so as to modify the surface condition of the printed image.

The dye layer may have one or more colors. The dye layer and the protective material layer may be sequentially formed on the first ribbon-shaped substrate sheet. A position detecting mark may be provided near each of the dye layer and the protective layer. The apparatus may further include detecting means for detecting the position detecting mark, the detecting means disposed in a moving path of the thermal transfer sheet. With this structure, the positions of the dye layer and the protective material layer of the thermal transfer sheet can be detected, and the desired one of the dye layer and the protective material layer can be aligned with the thermal head.

Preferably, the surface-property-modifying region includes one or more surface-property modifying regions of one or more types for modifying the surface of the protective layer on the image on the recording medium into the same or different types of surface conditions, the one or more surface-property modifying regions being sequentially formed on the second ribbon-shaped substrate sheet. Preferably, a position detecting mark is provided near each of the opening and the surface-property modifying regions and the apparatus further includes detecting means for detecting the position detecting mark, the detecting means disposed in a moving path of the surface-property-modifying sheet. With this structure, the positions of the hole for printing and the surface-property-modifying region of the surface-property-modifying sheet can be detected, and the desired one of the hole and the surface-property-modifying region can be aligned with the thermal head.

The surface-property-modifying region of the surface-property-modifying sheet may impart glossiness to the surface of the protective layer protecting the image formed on the recording medium. A glossy printed image can be obtained thereby.

Alternatively, the surface-property-modifying region of the surface-property-modifying sheet may a matte or embossed texture to the surface of the protective layer protecting the image on the recording medium.

Yet another embodiment provides an image-forming apparatus including conveying means for conveying a recording medium in a particular direction; thermal transfer sheet-moving means for moving a thermal transfer sheet in a particular direction, the thermal transfer sheet including a ribbon-shaped substrate sheet, a dye layer for forming an image by being thermally transferred onto a surface of the recording medium, a protective material layer for forming a protective layer protecting the image by being thermally transferred onto the surface of the image, and a surface-property-modifying region for modifying a surface condition of the protective layer; the dye layer, the protective material layer, and the surface-property-modifying region being arranged side-by-side on the ribbon-shaped substrate sheet in a longitudinal direction of the ribbon-shaped substrate sheet; and a thermal head for applying thermal energy while arranging the recording medium to face the dye layer or the protective material layer of the thermal transfer sheet so as to thermally transfer the dye layer and the protective material layer sequentially onto the surface of the recording medium. After the image is formed on the recording medium and the protective layer is formed on the image using the thermal transfer sheet, the surface-property-modifying region is aligned with the surface of the recording medium where the protective layer is formed and heat and pressure are applied from the thermal head to modify the surface condition of the protective layer formed on the recording medium. Thus, depending on the type of the surface-property-modifying region of the surface-property-modifying sheet, the surface condition of the protective layer can be imparted a glossy, matte, or embossed texture so as to modify the surface condition of the printed image.

The dye layer may have one or more colors, the surface-property-modifying region may include one or more surface-property-modifying regions of one or more types, and the dye layer, the protective material layer, and the one or more surface-property-modifying regions may be sequentially formed on the ribbon-shaped substrate sheet of the thermal transfer sheet. A position detecting mark may be provided near each of the dye layer, the protective material layer, and the one or more surface-property-modifying regions, and the apparatus may further include detecting means for detecting the position detecting mark, disposed in a moving path of the thermal transfer sheet.

Still another embodiment provides a surface-property-modifying sheet including a ribbon-shaped substrate sheet and a plurality of surface-property-modifying regions of at least one type for modifying a surface condition of a protective layer that protects an image formed on a recording medium used in an image-forming apparatus. The surface-property-modifying regions are arranged side-by-side on the ribbon-shaped substrate sheet in a longitudinal direction of the ribbon-shaped substrate. Thus, depending on the type of the surface-property-modifying region of the surface-property-modifying sheet, the surface condition of the protective layer can be imparted a glossy, matte, or embossed texture so as to modify the surface condition of the printed image.

The ribbon-shaped substrate sheet may have an opening for printing that allows the thermal transfer sheet to directly contact a surface of the recording medium, and the surface-property-modifying regions of one or more types may modify the surface of the protective layer on the image on the recording sheet into the same or different conditions. The opening and the surface-property-modifying regions may be sequentially formed in the ribbon-shaped substrate sheet, and a position detecting mark may be provided near each of the opening and the surface-property-modifying regions.

Each of the surface-property-modifying regions may be made of a resin film, a polyimide film in particular, having a heat resistance near a glass transition temperature of a protective material layer of a thermal transfer sheet used in the image-forming apparatus. Thus, the surface-property-modifying region does not deteriorate by heat applied from the thermal head and the surface condition of the protective layer can be satisfactorily modified.

The surface-property-modifying regions may be subjected to releasing treatment such that the surface-property-modifying regions do not adhere to a surface of a protective material layer of a thermal transfer sheet used in the image-forming apparatus near a glass transition temperature of the protective material layer. Thus, the surface-property-modifying region can be detached from the surface of the protective layer even after heat is applied from the thermal head.

The surface-property-modifying regions may impart glossiness to a surface of a protective layer protecting an image formed on a recording medium. Thus, a gloss-finished printed image can be obtained.

The surface-property-modifying regions may impart a matte or embossed texture to the surface of the protective layer protecting the image on the recording medium. Thus, a matte or embossed printed image can be obtained.

Another embodiment provides a thermal transfer sheet including a ribbon-shaped substrate sheet; a dye layer for forming an image by being thermally transferred onto a surface of a recording medium used in an image-forming apparatus; a protective material layer for forming a protective layer protecting the image by being thermally transferred onto a surface of the image formed on the surface of the recording medium; and a surface-property-modifying region of at least one type for modifying a surface condition of the protective layer. In this sheet, the dye layer, the protective material layer, and the surface-property-modifying region are arranged side-by-side on the ribbon-shaped substrate sheet in a longitudinal direction of the ribbon-shaped substrate sheet.

The dye layer may have one or more colors, the dye layer, the protective material layer, and the surface-property-modifying region may be sequentially formed on the ribbon-shaped substrate sheet, and a position detecting mark may be provided near each of the dye layer, the protective material layer, and the surface-property-modifying region. Accordingly, the positions of the dye layer, the protective material layer, and the surface-property-modifying region of the thermal transfer sheet can be detected.

The surface-property-modifying region may be an exposed portion of the ribbon-shaped substrate sheet. In this manner, the cost for material for the surface-property-modifying region can be reduced and the production of the thermal transfer sheet can be streamlined.

The surface-property-modifying region may impart glossiness to the surface of the protective layer protecting the image formed on the recording medium. A glossy printed image can be obtained as a result.

Alternatively, the surface-property-modifying region may impart a matte or embossed texture to the surface of the protective layer protecting the image on the recording medium. A matte or embossed printed image can be obtained as a result.

DESCRIPTION OF THE PREFERRED EMBODIMENTS

Figure 1:
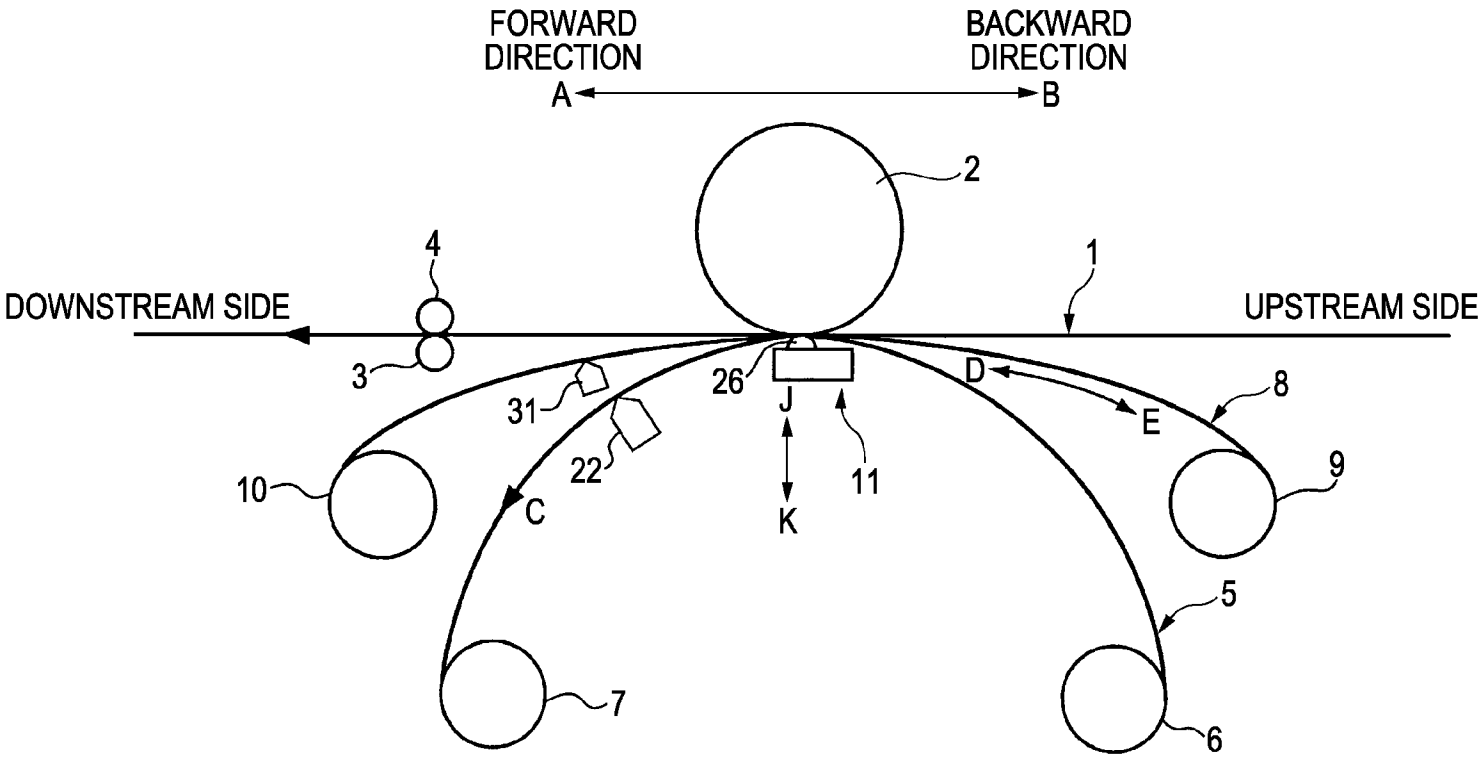
FIG. 1 is a schematic view showing an image-forming apparatus of a first embodiment used in an image-forming method.

Embodiments of the present invention will now be described in detail with reference to the attached drawings. FIG. 1 is a schematic view showing an image-forming apparatus of a first embodiment used in an image-forming method. This image-forming apparatus (e.g., thermal printer) can form an image on a recording medium by using a thermal transfer sheet, and a protective layer for protecting the surface of the image. The image-forming apparatus includes a platen roller 2, a pinch roller 3, a capstan roller 4, a feed reel 6 for a thermal transfer sheet 5, a take-up reel 7, a feed reel 9 for a surface-property-modifying sheet 8, a take-up reel 10, and a thermal head 11. In the description below, the case of forming an image on a recording paper sheet 1 of a roll type (hereinafter this operation is also referred to as "printing") is described.

The recording paper sheet 1 is a recording medium on which the image-forming apparatus forms an image. For example, the recording paper sheet 1 is a sublimating dye transfer recording paper sheet. The platen roller 2 holds the recording paper sheet 1 during printing. The pinch roller 3 and the capstan roller 4 oppose each other with the recording paper sheet 1 therebetween and synchronously rotate in opposite directions so as to feed the recording paper sheet 1 in a predetermined direction or backwind in the opposite direction. The platen roller 2, the pinch roller 3, the capstan roller 4, and a roller driving mechanism not shown in the drawing constitute a conveying unit that conveys the recording paper sheet 1 in desired directions.

For the sake of convenience, the conveying direction of the recording paper sheet 1 is defined as follows referring to FIG. 1: The direction in which the recording paper sheet 1 with an image formed thereon is discharged from the image-forming apparatus is the forward direction A and this side is referred to as "downstream side"; and the direction opposite to the forward direction A is the backward direction B and this side is referred to as "upstream side".

Figure 2A:
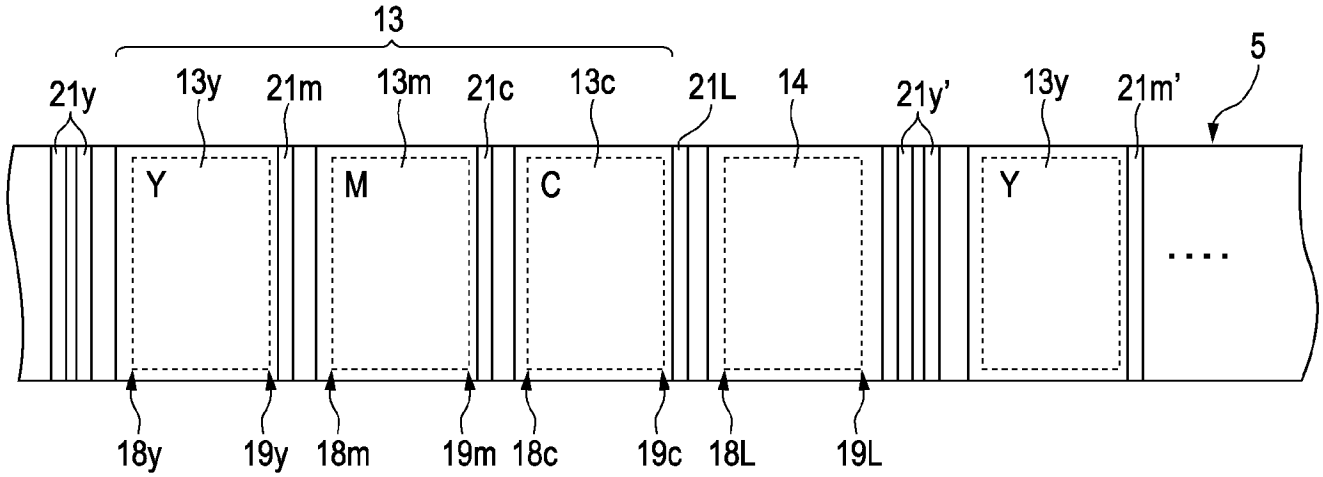
FIG. 2A is a plan view showing an embodiment of a thermal transfer sheet used in the image-forming apparatus of the first embodiment and FIG. 2B is a central vertical cross-sectional view of the transfer sheet.

The image-forming apparatus uses the thermal transfer sheet 5 to thermally transfer an image onto the surface of the recording paper sheet 1. As shown in FIG. 2A, a dye layer 13 of one or more colors for forming an image on the recording paper sheet 1 by thermal transfer and a protective material layer 14 for protecting the image on the recording paper sheet 1 are provided on a ribbon-shaped substrate sheet 12 while being arranged side-by-side in the longitudinal direction of the substrate sheet 12. The substrate sheet 12 with these layers formed thereon is usually referred to as "ink ribbon". The protective material layer 14 enhances the wear resistance and chemical resistance of the image formed on the surface of the recording paper sheet 1. Addition of a UV absorber into the protective material layer 14 can enhance light fastness of the image. Any available thermoplastic resin such as polystyrene resin can be used to form the protective material layer 14. The protective material layer 14 may have a multilayer structure including an uppermost adhesive sublayer (the top layer of the multilayer structure) for improving the adhesion of the protective material layer 14 to the recording paper sheet 1 and to the surface of the image formed on the recording paper sheet 1. In this embodiment, the protective material layer 14 is constituted by two sublayers, namely, a polystyrene resin sublayer and an acryl-modified resin sublayer on the polystyrene resin sublayer.

Figure 2B:
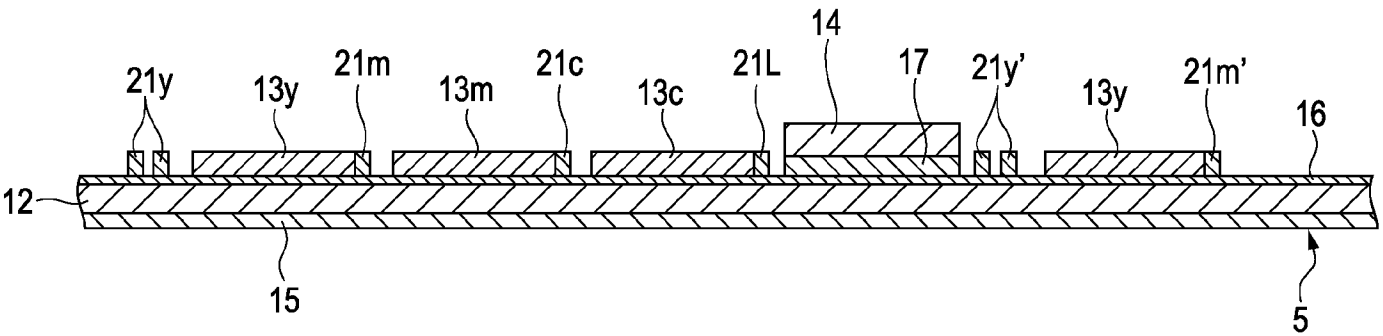

Referring now to FIG. 2B, a heat-resistant lubricating layer 15 is formed on the rear side of the substrate sheet 12 and an adhesive layer 16 is formed on the front side of the substrate sheet 12. The dye layers, for example, dye layers 13*y*, 13*m*, and 13*c* of yellow (Y), magenta (M), and cyan (C) colors, respectively, for forming an image on the surface of the recording paper sheet 1 by sublimation transfer or fusion transfer, and the protective material layer 14 for protecting the image formed on the surface of the recording paper sheet 1 are formed side-by-side on the adhesive layer 16 and have adequate thicknesses. A detachment layer 17 is interposed between the lower face of the protective material layer 14 and the adhesive layer 16. As shown in FIG. 2A, the four regions, i.e., the dye layers 13*y*, 13*m*, and 13*c* and the protective material layer 14, form one constitutional unit, which is used to form a color or monochrome image. In order to enable printing of a plurality of images, the constitutional units are repeatedly arranged along the longitudinal direction (winding direction) of the thermal transfer sheet 5. In addition to the yellow, magenta, and cyan dye layers, a black dye layer may be provided in the dye layer 13. Alternatively, only a black dye layer (Bk) may be provided in the dye layer 13.

In FIG. 2A, reference numeral 18*y* denotes the lead position of the yellow dye layer 13*y* and 19*y* denotes the tail position; reference numeral 18*m* denotes the lead position of the magenta dye layer 13*m* and 19*y* denotes the tail position; reference numeral 18*c* denotes the lead position of the cyan dye layer 13*c* and 19*c* denotes the tail position; and reference numeral 18L denotes the lead position of the protective material layer 14 and 19L denotes the tail position.

As shown in FIGS. 2A and 2B, an ink position-detecting mark 21*y* for detecting the position of the dye layer 13*y* that heads the constitutional unit constituted by four regions, i.e., the dye layers 13*y*, 13*m* and 13*c* and the protective material layer 14, is also provided. The ink position-detecting mark 21*y* is provided near the dye layer 13*y*. An ink position-detecting mark 21*m* for detecting the position of the dye layer 13*m* is provided near the dye layer 13*m*. An ink position-detecting mark 21*c* for detecting the position of the dye layer 13*c* is provided near the dye layer 13*c*. A protective material layer position-detecting mark 21L for detecting the position of the protective material layer 14 is provided near the protective material layer 14. Furthermore, an ink position-detecting mark 21*y*' for detecting the position of another dye layer 13*y* that heads the next constitutional unit constituted by dye and protective material layers is provided.

Each of these position detecting marks is a linear marking extending across the substrate sheet 12. For example, the ink position-detecting marks 21*y* and 21*y*' indicating the positions of the dye layers 13*y* heading the constitutional units are each constituted by two lines. The ink position-detecting marks 21*m* and 21*c* indicating the positions of the dye layers 13*m* and 13*c* and the protective material layer position-detecting mark 21L indicating the position of the protective material layer 14 are each constituted by a single line.

Referring to FIG. 1, the thermal transfer sheet 5 having such a structure is stretched between the feed reel 6 and the take-up reel 7 while being housed in a ribbon cassette (not shown in the drawing). The ribbon cassette is detachably mountable to the main body of the apparatus. Once the ribbon cassette is loaded inside the main body of the apparatus, the thermal transfer sheet 5 between the platen roller 2 and the thermal head 11 can travel in the direction of arrow C while synchronizing with conveying of the recording paper sheet 1. The feed reel 6 and the take-up reel 7 constitute a thermal transfer sheet-moving unit that allows the thermal transfer sheet 5 to move in a desired direction. Please note that thermal transfer sheet 5, the feed reel 6, and the take-up reel 7 need not be housed in the ribbon cassette but may be disposed in appropriate positions for operation in the apparatus main body.

An optical sensor 22 is disposed in the path of where the thermal transfer sheet 5 travels driven by the thermal transfer sheet-moving unit. The optical sensor 22 detects the position-detecting marks 21*y*, 21*y*', 21*m*, 21*c*, and 21L of the thermal transfer sheet 5. As shown in FIG. 1, the optical sensor 22 is disposed at a position a predetermined distance away in the travelling direction indicated by arrow C, from the position of the thermal head 11 during printing. According to this system, when the position-detecting mark 21*y* is detected, the recording region of the thermal head 11 aligns with the dye layer 13*y*. The same applies to the position-detecting mark 21*y*' and the dye layer 13*y* in the next constitutional unit, the position-detecting mark 21*m* and the dye layer 13*m*, the position-detecting mark 21*c* and the dye layer 13*c*, and the position-detecting mark 21L and the protective material layer 14.

Figure 3A:
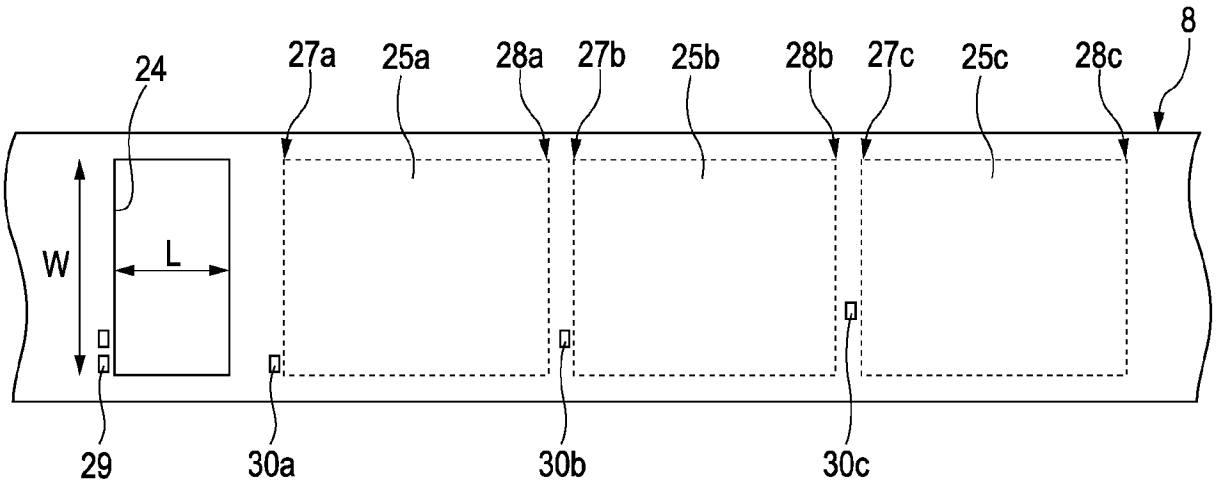
FIG. 3A is a plan view showing an embodiment of a surface-property-modifying sheet used in the image-forming apparatus and FIG. 3B is a central vertical cross-sectional view of the surface-property-modifying sheet.

The surface-property-modifying sheet 8 modifies the surface conditions of the protective layer that protects the image formed on the recording paper sheet 1 with the above-described image-forming apparatus. As shown in FIG. 3A, an opening 24 for printing that allows the thermal transfer sheet 5 to directly contact the surface of the recording paper sheet 1, and surface-property-modifying regions 25*a*, 25*b*, and 25*c* for modifying the surface conditions of the protective layer protecting the image formed on the recording paper sheet 1 are arranged on a ribbon-shaped substrate sheet 23 so that they align side-by-side in the longitudinal direction of the substrate sheet 23.

The substrate sheet 23 also serves as a surface-property-modifying member for modifying the surface conditions of the protective layer that protects the image formed on the recording paper sheet 1 and has a shape of a ribbon having an adequate length. The substrate sheet 23 is composed of a resin film having heat resistance near the glass transition temperature (Tg) of the protective material layer 14 of the thermal transfer sheet 5 of the image-forming apparatus. For example, the substrate sheet 23 is made from a polyimide film. In particular, a polyimide film, Upilex S (trade name, product of Ube Industries Ltd.) having a thickness of about 25 μm may be used. Since the surface property of this polyimide film is extremely flat and smooth, the surface of the protective layer on the image formed on the recording paper sheet 1 also becomes flat and smooth due to the flat and smooth surface of the polyimide film.

The surface-property-modifying regions 25*a*, 25*b*, and 25*c* of the substrate sheet 23 are preferably subjected to releasing treatment so that the surface-property-modifying regions 25*a*, 25*b*, and 25*c* do not adhere to the surface of the protective layer protecting the image formed on the recording paper sheet 1 when the temperature is near the glass transition temperature (Tg) of the protective material layer 14 of the thermal transfer sheet 5 of the image-forming apparatus. The releasing treatment suppresses detachment failure caused by cohesive failure inside the protective layer or the like when the surface-property-modifying sheet 8 is detached from the surface-modified protective layer on the image formed on the recording paper sheet 1. Thus, satisfactory interfacial detachment is possible at the interface between the protective layer on the recording paper sheet 1 and the surface-property-modifying regions 25*a*, 25*b*, and 25*c*. As a result, the surface of the protective layer on the image formed on the recording paper sheet 1 is in an excellent finished condition after the surface modification treatment.

The material for the substrate sheet 23 need not be limited to Upilex S (trade name, product of Ube Industries Ltd.) and may be any of super-engineering plastic materials and engineering plastic materials that have sufficient heat resistance against the temperature during surface modification treatment, such as Kapton (trade name, product of DuPont) or any other suitable polyimide, polysulfone, polyether imide, or polyethylene terephthalate (PET).

The opening 24 allows the thermal transfer sheet 5 to directly contact the surface of the recording paper sheet 1. For example, the opening 24 may be rectangular in shape in a plan view. Referring to FIG. 3A, the width W of the opening 24 in the transversal direction of the substrate sheet 23 is slightly larger than the length of the thermal head 11 in the main scanning direction (direction perpendicular to the plane of the paper in FIG. 1), and the length L of the opening 24 in the longitudinal direction of the substrate sheet 23 is slightly larger than the length of the thermal head 11 in the sub scanning direction (direction parallel to the plane of paper in FIG. 1). Accordingly, during usual printing operation and protective layer-forming operation on the recording paper sheet 1, the thermal head 11 is pressed against the recording paper sheet 1 with the thermal transfer sheet 5 between the recording paper sheet 1 and the thermal head 11 while the recording paper sheet 1 and the thermal transfer sheet 5 are being moved, so that an image can be formed using the thermal head 11 and a protective layer can be formed on the image.

The width W of the opening 24 need not be larger than the length of the thermal head 11 in the main scanning direction and the length L of the opening 24 need not be larger than the length of the thermal head 11 in the sub scanning direction. For example, the width W and the length L of the opening 24 may at least be larger than the width and length of a printing heater-forming region (printing heater is not shown in the drawing) of the thermal head 11 and a nearby region where a projecting glaze 26 is formed.

The surface-property-modifying regions 25*a*, 25*b*, and 25*c* modify the surface conditions of the protective layer that protects the image formed on the recording paper sheet 1. For example, a plurality of types of surface-property-modifying regions are provided side-by-side next to the opening 24 to modify the surface of the protective layer into different surface conditions. For example, the first surface-property-modifying region 25*a* is for glossy finish, the second surface-property-modifying region 25*b* is for matte finish, and the third surface-property-modifying region 25*c* is for another type of matte finish (also referred to as "embossed finish" in this specification). The number of types of surface conditions for modification and the order in which these regions are arranged are not limited to those described above. For example, only one of the surface-property-modifying regions may be provided. Alternatively, on the basis of anticipated frequency of surface-modification treatment of the protective layer protecting the image on the recording paper sheet 1, a plurality of surface-property-modifying regions for glossy finish, for example, may be disposed at different positions.

In FIG. 3A, reference numeral 27*a* denotes the lead position and reference numeral 28*a* denotes the tail position of the surface-property-modifying region 25*a*; reference numerals 27*b* and 28*b* respectively denote the lead and tail position of the surface-property-modifying region 25*b*; and reference numerals 27*c* and 28*c* respectively denotes the lead and tail positions of the surface-property-modifying region 25*c*.

Referring to FIG. 3A, reference numeral 29 denotes an opening position-detecting mark provided near the opening 24 to allow detection of the lead position of the opening 24; reference numeral 30*a* denotes a modifying region-detecting mark provided near the surface-property-modifying region 25*a* to allow detection of the surface-property-modifying region 25*a*; reference numeral 30*b* denotes a modifying region-detecting mark provided near the surface-property-modifying region 25*b* to allow detection of the surface-property-modifying region 25*b*; and reference numeral 30*c* denotes a modifying region-detecting mark provided near the surface-property-modifying region 25*c* to allow detection of the surface-property-modifying region 25*c*.

The position-detecting marks 29, 30*a*, 30*b*, and 30*c* are marking holes of predetermined sizes penetrating the substrate sheet 23. The modifying region position-detecting mark 29 is constituted by two marking holes. The modifying region position-detecting marks 30*a*, 30*b*, and 30*c* are each constituted by one marking hole and distinguished from one another by shifting the positions of marking holes.

As shown in FIG. 1, the surface-property-modifying sheet 8 having such a structure is stretched between the feed reel 9 and the take-up reel 10 and is detachably mountable to the main body of the apparatus. Once the surface-property-modifying sheet 8 stretched between the feed reel 9 and the take-up reel 10 is mounted inside the apparatus, the surface-property-modifying sheet 8 between the platen roller 2 and the thermal head 11 can move along with the thermal transfer sheet 5 in the directions of arrows D and E by synchronizing with the conveying of the recording paper sheet 1. The feed reel 9 and the take-up reel 10 constitute a modifying sheet-moving unit for moving the surface-property-modifying sheet 8.

A mechanical sensor 31 is provided in the path where the surface-property-modifying sheet 8 travels as driven by the modifying sheet-moving unit. The mechanical sensor 31 detects the position-detecting marks 29, 30*a*, 30*b*, and 30*c* of the surface-property-modifying sheet 8. As shown in FIG. 1, the mechanical sensor 31 is located a predetermined distant away in the travelling direction indicated by arrow D from the position of the thermal head 11 during printing. According to this system, when the position-detecting mark 29*a* is detected, the recording region of the thermal head 11 aligns with the opening 24. The same applies to the position-detecting mark 30*a* and the surface-property-modifying region 25*a*, the position-detecting mark 30*b* and the surface-property-modifying region 25*b*, and the position-detecting mark 30*c* and the surface-property-modifying region 25*c*.

Figure 4:
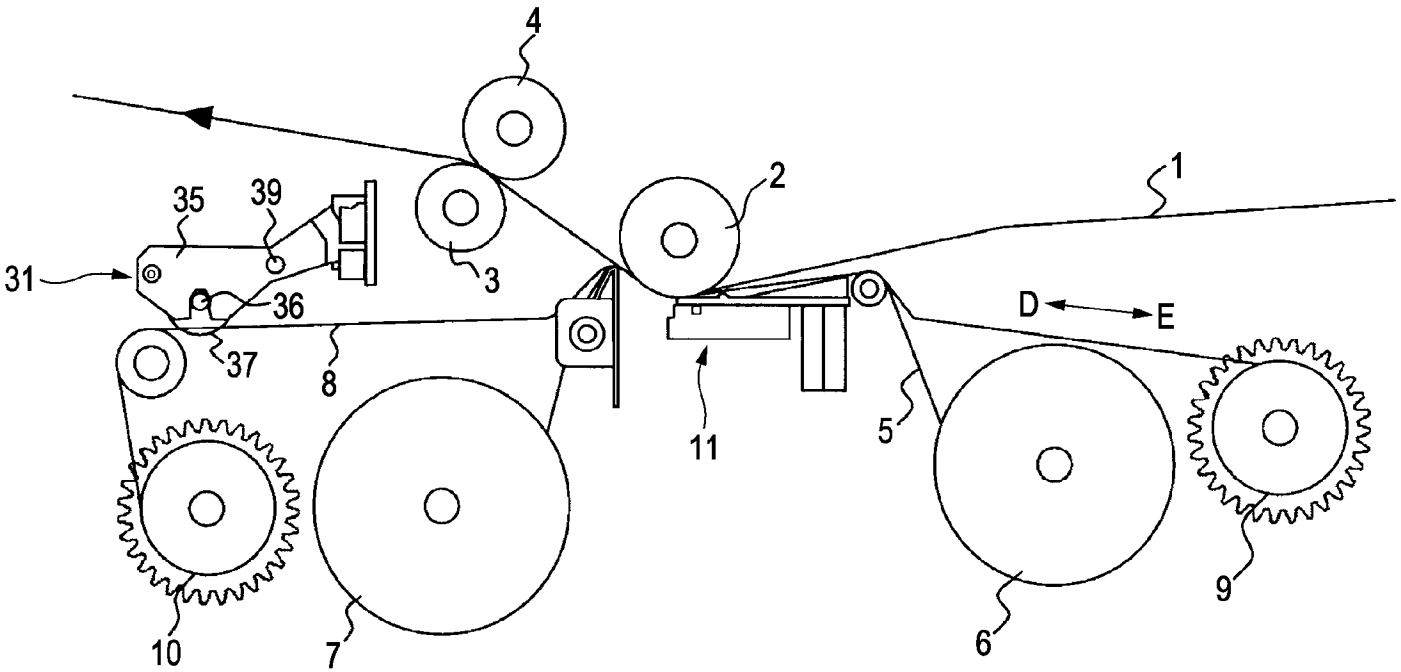
FIG. 4 is a schematic view showing a specific structure corresponding to the image-forming apparatus shown in FIG. 1.

Specific structures and operations of the mechanical sensor 31 will now be described with reference to FIGS. 4 to 6B. FIG. 4 is a schematic view showing a detailed mechanism of a structure corresponding to the image-forming apparatus shown in FIG. 1, and like components are represented by like reference numerals. The mechanical sensor 31 is mounted on a sensor substrate 35 accommodated in a housing (not shown in the drawing) of a thermal printer, for example. The mechanical sensor 31 includes a roller 37 at an end portion where the mechanical sensor 31 contacts the surface of the surface-property-modifying sheet 8. The roller 37 is rotatably supported on a shaft 36.

Figure 5A:
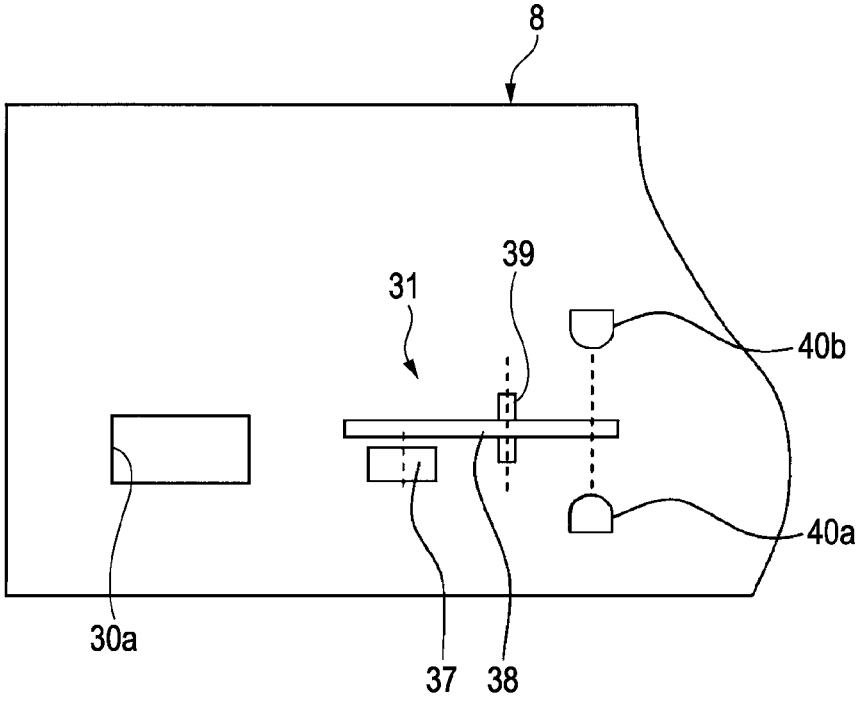
FIG. 5A is a top view showing an internal structure of a mechanical sensor mounted on a sensor substrate shown in FIG. 4
Figure 5B:
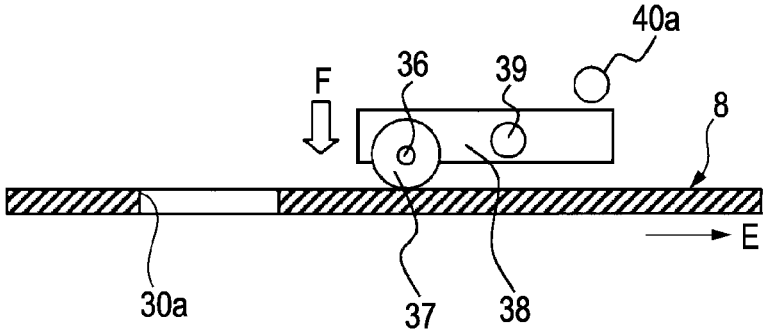
FIG. 5B is a front view of the internal structure.

FIG. 5A is a plan view showing the inside structure of the mechanical sensor 31 mounted on the sensor substrate 35. FIG. 5B is a front view of the mechanical sensor 31. In the sensor substrate 35, an actuator 38 having, for example, a narrow and elongated plate shape is rockably supported on a fulcrum shaft 39 disposed at a lopsided position. The roller 37 supported on the shaft 36 is provided at one end, e.g., the left end, of the actuator 38 so that the roller 37 can rotate by being driven by the movement of the surface-property-modifying sheet 8. In such a case, as shown in FIG. 5A, the actuator 38 and the roller 37 are disposed along the path in which surface-property-modifying region 30*a*, 30*b*, and 30*c* pass as the surface-property-modifying sheet 8 travels. Moreover, as shown in FIG. 5B, since the fulcrum shaft 39 is disposed at the right-hand side of the actuator 38 to provide a lopsided support, the left end of the actuator 38 is urged downward by force F due to the balance between the dead weight of the actuator 38 itself and the weight of the roller 37. This force of urging is controlled to a level that does not deform the surface-property-modifying sheet 8. If necessary, a spring of an appropriate strength may be additionally provided for urging.

A light-emitting member 40*a* such as a light-emitting diode and a light-receiving member such as a photosensor 40*b* are disposed at two sides of the other end, e.g., the right end, of the actuator 38, as shown in FIG. 5A. The actuator 38 is configured so that the optical axis between the light-emitting member 40*a* and the photosensor 40*b* is interrupted by the right end of the actuator 38 as the actuator 38 rocks. The actuator 38, the roller 37, the light-emitting member 40*a*, and the photosensor 40*b* in this state constitute the mechanical sensor 31.

The operation of the mechanical sensor 31 having the above-described structure will now be described with reference to FIGS. 5A to 6B. FIG. 5A shows a state before the modifying region position-detecting mark 30*a* indicating the lead position of the surface-property-modifying region 25*a* of the surface-property-modifying sheet 8 shown in FIG. 3A is detected. The roller 37 of the mechanical sensor 31 is rotated as it is driven by making contact with the surface of the surface-property-modifying sheet 8 moving in the arrow E direction. During this operation, as shown in FIG. 5B, the right side end of the actuator 38 does not rock and thus does not intercept the optical axis between the light-emitting member 40*a* and the photosensor 40*b*.

Figure 6A:
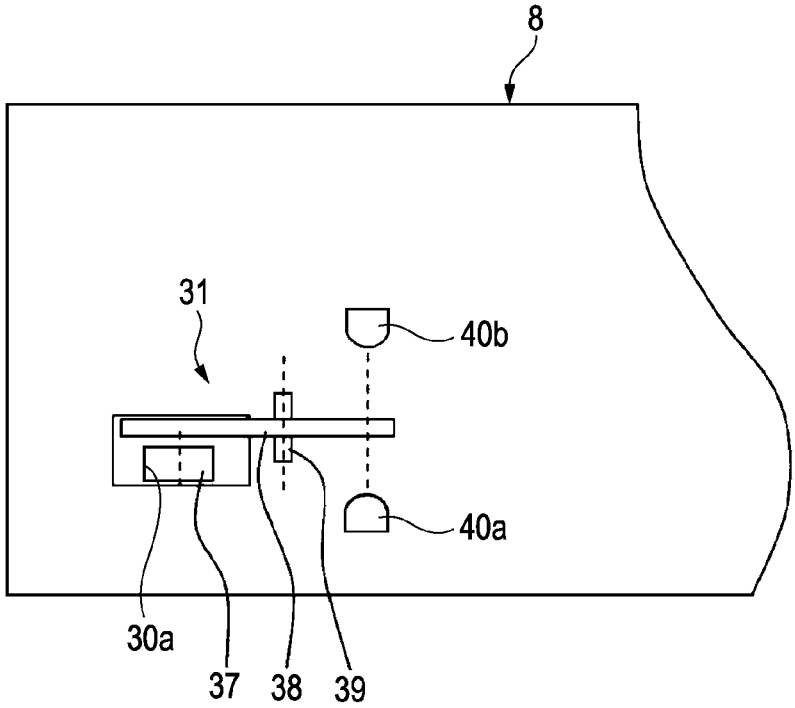
FIG. 6A is a top view showing operation of the mechanical sensor having the structure shown in FIGS. 5A and 5B and FIG. 6B is a front view of the mechanical sensor.
Figure 6B:
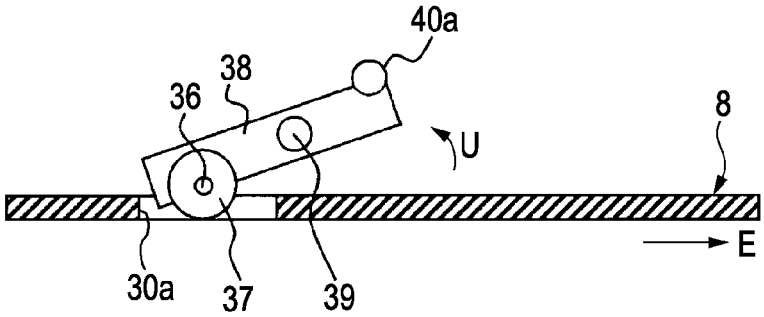

As the modifying region position-detecting mark 30*a* moves to the position of the roller 37 of the mechanical sensor 31 as shown in FIG. 6B due to the movement of the surface-property-modifying sheet 8 in the direction of arrow E, the roller 37 falls in the marking hole serving as the modifying region position-detecting mark 30*a* due to the force F of urging shown in FIG. 5B. As a result, the right side end of the actuator 38 moves upward as indicated by arrow U and intercept the optical axis between the light-emitting member 40*a* and the photosensor 40*b*. Thus, the mechanical sensor 31 detects that the modifying region position-detecting mark 30*a* has reached the position of the mechanical sensor 31, that is, the mechanical sensor 31 detects the lead position of the surface-property-modifying region 25*a* of the surface-property-modifying sheet 8.

The combination of the position-detecting marks and the mechanical sensor is not limited to the combination of the above-described position-detecting marks 29, 30*a*, 30*b*, and 30*c* and the mechanical sensor 31. Any other suitable combination that can detect the position may be employed. For example, instead of penetrating holes, light-shielding marks printed on the surface of the substrate sheet 23 may be used as the position-detecting marks 29, 30*a*, 30*b*, and 30*c*, and a light transmission sensor may be used instead of the mechanical sensor 31. Alternatively, a combination of light-shielding marks and a reflection sensor or a reflective plate may be employed. In the case where the substrate sheet 23 has high light-shielding ability, a combination of penetrating holes and a light transmission sensor may be employed.

Figure 7A:
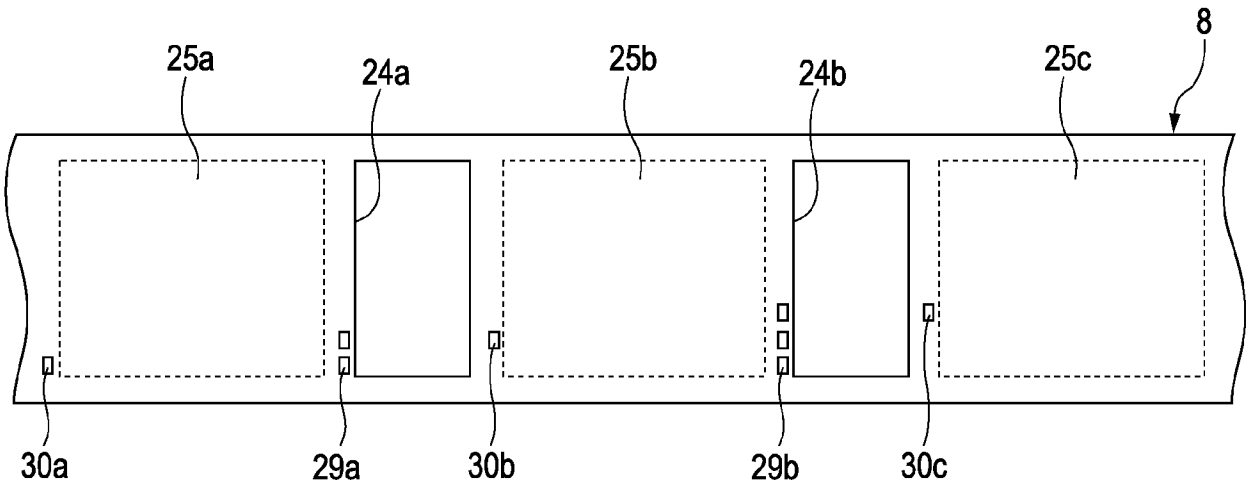
FIG. 7A is a plan view showing another embodiment of the surface-property-modifying sheet and FIG. 7B is a central vertical cross-sectional view of the surface-property-modifying sheet.
Figure 7B:
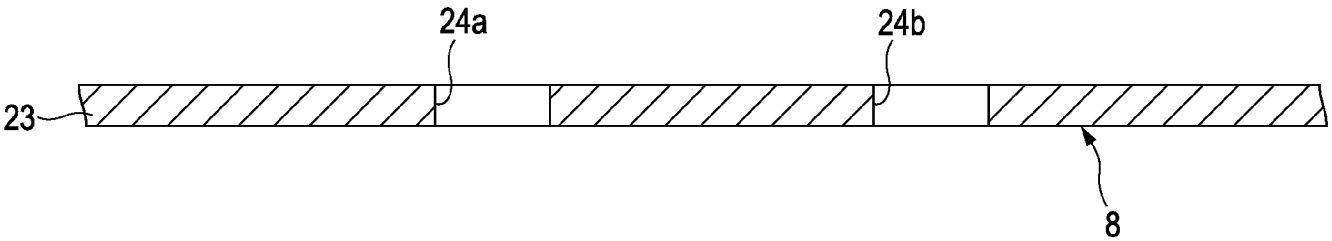

FIGS. 7A and 7B are diagrams showing another embodiment of the surface-property-modifying sheet 8. In this embodiment, a plurality of openings 24*a* and 24*b* for printing are provided in the spaces between the surface-property-modifying regions 25*a*, 25*b*, and 25*c*. As shown in FIG. 7A, surface-property-modifying regions and openings for printing are arranged in an alternating fashion. That is, the opening 24*a* is adjacent to the surface-property-modifying region 25*a* and surface-property-modifying region 25*b*. The opening 24*b* is adjacent to the surface-property-modifying region 25*b* and the surface-property-modifying region 25*c*. As shown in FIG. 7A, reference numeral 29*a* denotes an opening position-detecting mark (two marking holes) disposed near the opening 24*a* to indicate the lead position of the opening 24*a*; and reference numeral 29*b* denotes an opening position-detecting mark (three marking holes) provided near the opening 24*b* to indicate the lead position of the hole 24*b*.

In this embodiment, during printing on the recording paper sheet 1, an appropriate one of the openings 24*a* and 24*b* is selected depending on the type of modification to be effected on the surface of the image formed on the recording paper sheet 1. For example, if two or more images are to be printed sequentially and emboss-finished by using the surface-property-modifying region 25*c*, surface modification treatment on the first image may be performed using the surface-property-modifying region 25*c* and then the opening 24*b* may be selected to conduct the subsequent printing operation. In this manner, since the opening 24*b* is near the surface-property-modifying region 25*c*, the travel distance of the surface-property-modifying sheet 8 is small and time efficiency can be improved.

In this embodiment also, the mechanical sensor 31 is provided in the path of the surface-property-modifying sheet 8 moved by the modifying sheet-moving unit. The specific structures and operation of the mechanical sensor 31 are the same as those described with reference to FIGS. 4 to 6B above.

In the embodiments shown in FIGS. 3A, 3B, 7A, and 7B, the surface-property-modifying sheet 8 is constituted by the substrate sheet 23 alone. However, the structure of the surface-property-modifying sheet 8 is not limited to this. Alternatively, an adequate reinforcing member may be used with the substrate sheet 23 for the purpose of reinforcement. For example, a metal reinforcing layer may be provided in the portions where the openings 24 are formed and portions other than the surface-property-modifying regions 25*a*, 25*b*, and

25*c* where the heater unit of the thermal head 11 contacts the substrate sheet 23 with the thermal transfer sheet 5 in between. Yet alternatively, the thickness of the substrate sheet 23 in these portions may be locally increased to the same effect.

Figure 3B:
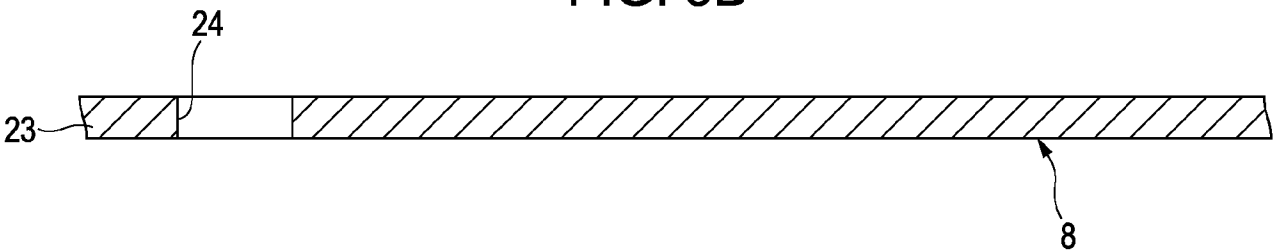
Figures 8A, 8B, 8C, 8D, 8E, 8F, 8G, 8H:
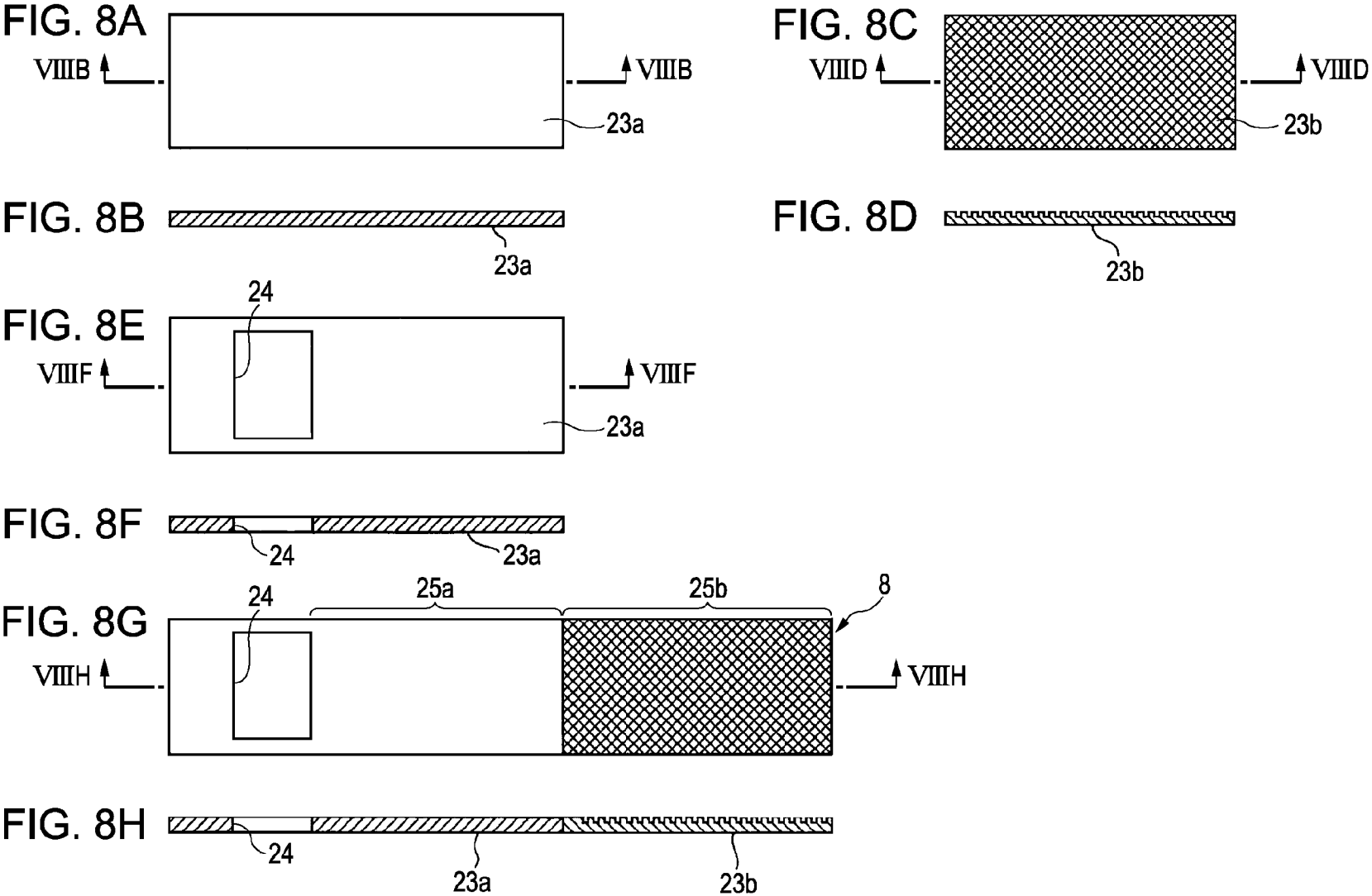
FIGS. 8A to 8H are diagrams showing the steps of manufacturing the surface-property-modifying sheet shown in FIGS. 3A and 3B.

FIGS. 8A to 8H show an example of the process of making the surface-property-modifying sheet 8 shown in FIGS. 3A and 3B. FIG. 8A is a plan view showing a substrate sheet 23*a* that forms the surface-property-modifying region 25*a* for glossy finish shown in FIG. 3A. FIG. 8B is a cross-sectional view taken along line VIIIB-VIIIB in FIG. 8A. In this embodiment, the substrate sheet 23*a* is a single component. A polyimide, such as Upilex S (trade name, product of Ube Industries Ltd.), is used as this single component of the substrate sheet 23*a* to prepare a component that forms the surface-property-modifying region 25*a*.

FIG. 8C is a plan view showing a substrate sheet 23*b* that forms the surface-property-modifying region 25*b* for a matte finish shown in FIG. 3A. FIG. 8D is a cross-sectional view of the substrate sheet 23*b* taken along line VIIID-VIIID in FIG. 8C. In this embodiment, the substrate sheet 23*b* is a single component. A polyimide, such as Upilex S (trade name, product of Ube Industries Ltd.), is subjected to sand-blasting or the like to form desired asperities in the surface and used as this single component of the substrate sheet 23*b* to prepare for the making of the surface-property-modifying region 25*b*. It is also possible to prepare a component for forming the surface-property-modifying region 25*c* for an embossed finish by adequately selecting the process conditions (e.g., the material and size of the particles used in sand blasting, blasting pressure, and other conditions) during sand blasting.

Another example of the method for making the components that form the surface-property-modifying regions 25*b* and 25*c* is to use a sheet member composed of, e.g., polyethylene terephthalate (PET), having a surface in which asperities are intentionally formed. This can be done by forming a sheet member by kneading pellets for forming the sheet member with a filler. A surface-property-modifying region that can give a matte finish (25*b*) or an embossed finish (25*c*) can be formed by controlling the particle size and amount of the filler added.

Another example of making the components that form the surface-property-modifying regions 25*b* and 25*c* is to use a transfer process in which, as shown in FIGS. 9A to 9E, a die member 32, such as an embossing roller, with a desired surface pattern formed by an existing process such as mechanical processing, etching, or discharge processing is used to transfer the pattern onto the surface of the substrate sheet 23*b* composed of a thermoplastic resin such as polyethylene terephthalate so that the substrate sheet 23*b* has surface asperities suitable for the desired finishing condition.

Figure 9A:
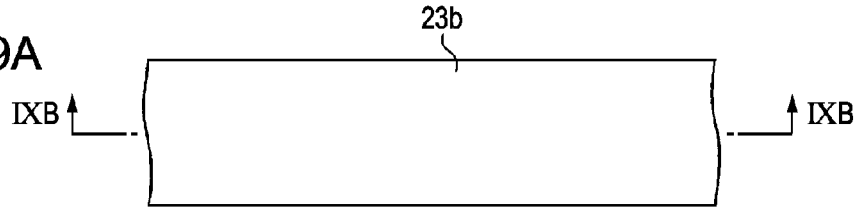
FIGS. 9A to 9E are diagrams showing another example of making a component that forms a surface-property-modifying region for a matte finish in the surface-property-modifying sheet shown in FIGS. 3A and 3B.
Figure 9B:
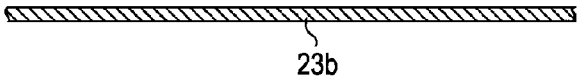
Figure 9C:
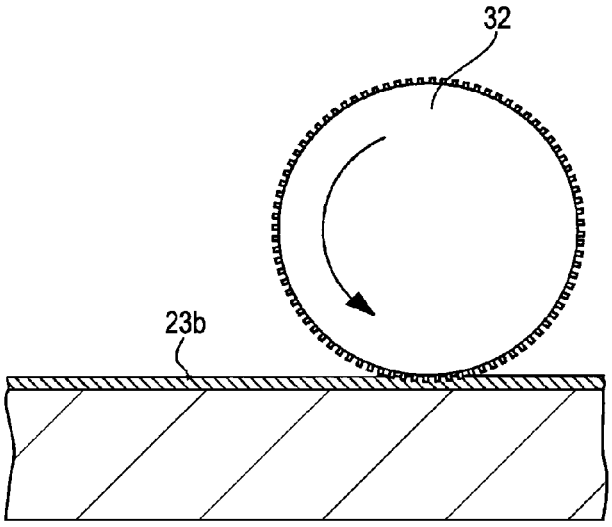
Figure 9D:
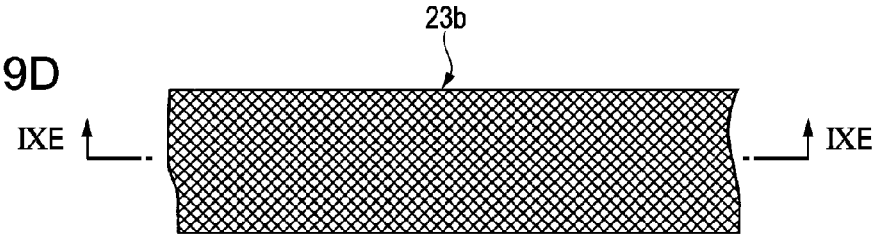
Figure 9E:
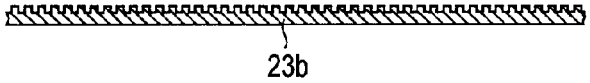

FIG. 9A is a plan view showing the substrate sheet 23*b* that forms the surface-property-modifying region 25*b* for matte finish in FIG. 3A. FIG. 9B is a cross-sectional view of the substrate sheet 23*b* taken along line IXB-IXB. FIG. 9C is a cross-sectional view showing transfer operation in which the pattern is transferred onto the surface of the substrate sheet 23*b* by pressing the die member 32 such as an embossing roller into the substrate sheet 23*b*, taken along line IXB-IXB in FIG. 9A. FIG. 9D is a plan view showing the substrate sheet 23*b* after transfer of the pattern, and FIG. 9E is a cross-sectional view taken along line IXE-IXE in FIG. 9D.

FIG. 8E is a plan view showing the opening 24 formed in the substrate sheet 23*a* which forms the surface-property-modifying region 25*a* shown in FIG. 8A. FIG. 8F is a cross-sectional view taken along line VIIIF-VIIIF in FIG. 8E. In this embodiment, part of the substrate sheet 23*a* is punched out by pressing a punch die having the same size as the opening 24 against the substrate sheet 23*a*.

FIG. 8G is a plan view showing the substrate sheet 23*a*, which forms the surface-property-modifying region 25*a* and has the opening 24 shown in FIG. 8E, connected to the substrate sheet 23*b* that forms the surface-property-modifying region 25*b* for matte finish shown in FIG. 8C. FIG. 8H is a cross-sectional view taken along line VIIIH-VIIIH in FIG. 8G. In this embodiment, one edge of the substrate sheet 23*a* is attached to the opposing edge of the substrate sheet 23*b* with an adhesive or the like. As a result, a single surface-property-modifying sheet 8 that has an opening 24, a surface-property-modifying region 25*a*, and a surface-property-modifying region 25*b* is formed.

In the embodiment shown in FIGS. 8A to 8H, the substrate sheets 23*a* and 23*b* are connected after forming the punched out portion corresponding to the opening 24 in the substrate sheet 23*a*; however, the order may be reversed, i.e., the substrate sheets 23*a* and 23*b* may be connected first and then the opening 24 may be formed in the substrate sheet 23*a*. The position detecting marks 29, 30*a*, 30*b*, and 30*c* (marking holes) may be formed in the individual substrate sheets 23*a* and 23*b* before connecting. However, in the case where the opening 24 is formed after the substrate sheets 23*a* and 23*b* are integrally connected as described above, the position detecting marks 29, 30*a*, 30*b*, and 30*c* may be made simultaneously with the opening 24 by punching or the like.

A surface-property-modifying sheet 8 that has a surface-property-modifying region 25*a*, a surface-property-modifying region 25*b*, and a surface-property-modifying region 25*c* as shown in FIG. 3A can also be formed in accordance to the process described above. A surface-property-modifying sheet 8 having openings 24A and 24*b* shown in FIG. 7A can also be formed by connecting a plurality of substrate sheets as described above.

The thermal head 11 thermally and sequentially transfers the dye layer 13 and the protective material layer 14 onto the recording paper sheet 1 by applying thermal energy while arranging the surface of the recording paper sheet 1 to oppose the dye layer 13 or protective material layer 14 of the thermal transfer sheet 5. The thermal head 11 has many heating elements aligned in a row extending in a direction substantially orthogonal to the travelling direction (arrow C direction) of the thermal transfer sheet 5 and generates thermal energy by independently driving the heating elements in response to the image data input to the thermal head 11 so that the dye layers 13*y*, 13*m*, and 13*c* and the protective material layer 14 on the thermal transfer sheet 5 are heated by the thermal energy.

The thermal head 11 is configured to move in the directions of arrows J and K shown in FIG. 1 by being driven by a head driving mechanism not shown in the drawing. In this case, during printing, the thermal head 11 moves in the arrow J direction to push up the thermal transfer sheet 5 from the rear side so that the thermal transfer sheet 5 is pressed against the platen roller 2 and the recording paper sheet 1 conveyed along the external peripheral face of the platen roller 2. During stand-by period or backwinding of the recording paper sheet 1 to the upstream side in the backward direction B, the thermal head 11 is retracted in the arrow K direction.

In this embodiment, first, an image is formed on the recording paper sheet 1 and a protective layer for protecting the image is formed on the image by using the thermal transfer sheet 5; the surface-property-modifying region 25*a*, 25*b*, or 25*c* of the surface-property-modifying sheet 8 is aligned with the face of the recording paper sheet 1 on which the protective layer is formed; and then heat and pressure are applied from the thermal head 11 so as to modify the surface condition of the protective layer formed on the recording paper sheet 1. For example, the protective layer on the recording paper sheet 1 may be rendered with a glossy, matte, or embossed texture.

An image-forming method in which the image-forming apparatus having the above-described structure is used will now be described. Referring to FIG. 1, the platen roller 2, the pinch roller 3, and the capstan roller 4 are driven by a roller driving mechanism not shown in the drawing so as to convey the recording paper sheet 1 in the desired direction. In this manner, the position at which the image is to be formed on the recording paper sheet 1 is cued. As the initial setting, the surface-property-modifying sheet 8 is moved in a predetermined direction by operation of the modifying sheet-moving unit constituted by the feed reel 9 and the take-up reel 10 so that the opening 24 shown in FIGS. 3A and 3B or one of the openings 24*a* and 24*b* shown in FIGS. 7A and 7B aligns with the recording region of the thermal head 11 where the printing heaters and the glaze 26 nearby are formed.

In the next step, the thermal transfer sheet 5 is moved in the arrow C direction by the thermal transfer sheet-moving unit constituted by the feed reel 6 and the take-up reel 7. As a result, one of the dye layers 13*y*, 13*m*, and 13*c* of the thermal transfer sheet 5 shown in FIG. 2A aligns with the position at which the image is to be formed relative to the recording paper sheet 1. During this step, the optical sensor 22 shown in FIG. 1 detects the ink position-detecting marks 21*y*, 21*m*, and 21*c* of the thermal transfer sheet 5 to carry out alignment.

In the next step, the thermal head 11 is moved in the arrow J direction while arranging the thermal head 11 to face the recording paper sheet 1 and one of the dye layers 13*y*, 13*m*, and 13*c* of the thermal transfer sheet 5, and thermal energy is applied from the thermal head 11 while pushing up the thermal transfer sheet 5 from the rear side so that the thermal transfer sheet 5 is pressed against the platen roller 2 to thereby transfer the dye layer 13*y*, 13*m*, or 13*c* of the thermal transfer sheet 5 onto the surface of the recording paper sheet 1 to thereby form an image. As a result, an image is formed on the recording paper sheet 1 by using a desired one of the dye layers 13*y*, 13*m*, and 13*c*.

Figure 10A:
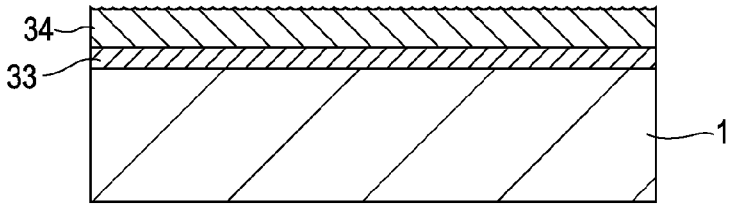
FIGS. 10A to 10D are diagrams showing an example of modifying the surface condition of a protective layer formed on an image on a recording medium while aligning the surface-property-modifying region of the surface-property-modifying sheet with the protective layer formed on the image on the recording medium in an image-forming method that uses the image-forming apparatus.

In the next step, thermal energy is applied from the thermal head 11 while arranging the image formed on the recording paper sheet 1 to face the protective material layer 14 of the thermal transfer sheet 5 so as to transfer the protective material layer 14 of the thermal transfer sheet 5 onto the image formed on the recording paper sheet 1. During this step, as mentioned earlier, a step of moving the thermal transfer sheet 5 in the arrow C direction by operating the thermal transfer sheet-moving unit while detecting the ink position-detecting marks 21*y*, 21*m*, and 21*c* and the protective material layer position-detecting mark 21L on the thermal transfer sheet 5 with the optical sensor 22 so as to align the protective material layer 14 with the position of the image formed on the recording paper sheet 1 is also carried out. As a result of thermal transfer of the protective material layer 14, as shown in FIG. 10A, a protective layer 34 is formed on the surface of an image 33 formed on the surface of the recording paper sheet 1. At this stage, the surface of the protective layer 34 is not modified yet and has insufficient glossiness.

Immediately after formation of the protective layer 34 on the surface of the image 33 on the recording paper sheet 1, the recording region of the thermal head 11 is at the tail position 19L after transfer of the protective material layer 14 of the thermal transfer sheet 5 shown in FIG. 2A. Thus, the thermal transfer sheet-moving unit is operated to backwind the thermal transfer sheet 5 to the position before transfer of the protective material layer 14, i.e., to the lead position 18L. At this stage, the opening 24 of the surface-property-modifying sheet 8 shown in FIG. 3A is located in the recording region of the thermal head 11.

In the next step, the surface-property-modifying sheet 8 is moved in the arrow D or E direction by operating the modifying sheet-moving unit constituted by the feed reel 9 and the take-up reel 10.

Figure 10B:
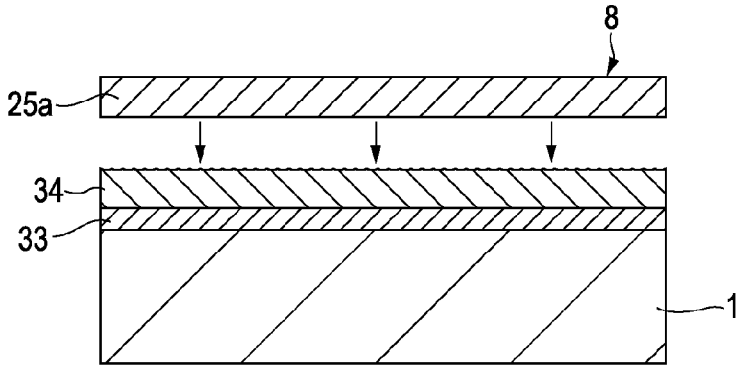

Then, the protective layer 34 on the image 33 of the recording paper sheet 1 is aligned with one of the surface-property-modifying regions 25*a*, 25*b*, and 25*c* of the surface-property-modifying sheet 8, heat and pressure is applied from by the thermal head 11, and the surface-property-modifying sheet 8 is detached after cooling to modify the surface condition of the protective layer 34. In other words, for example, as shown in FIG. 10B, the surface-property-modifying region 25*a* for gloss finishing is selected among the modifying regions of the surface-property-modifying sheet 8 shown in FIG. 3A and aligned with the position of the protective layer 34 formed on the surface of the image 33 on the recording paper sheet 1. During this process, the opening position-detecting marks 29, 30*a*, 30*b*, and 30*c* of the surface-property-modifying sheet 8 are detected by the mechanical sensor 31 shown in FIG. 1 to conduct the alignment.

Figure 10C:
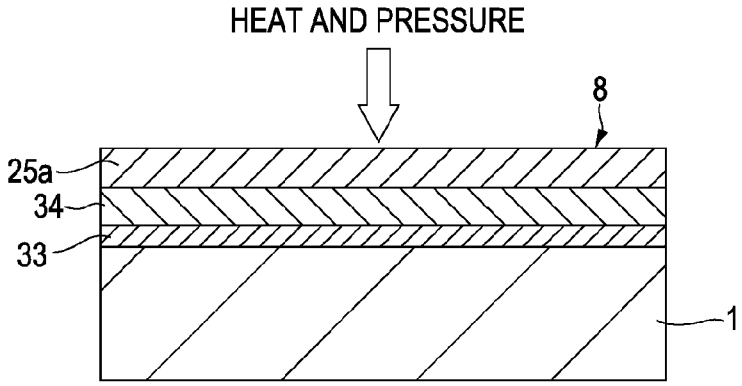

At this stage, the position the portion of the thermal transfer sheet 5 where the protective material layer 14 (not shown) used to lie before transfer, the surface-property-modifying region 25*a* of the surface-property-modifying sheet 8, and the position where the protective layer 34 is formed on the image 33 of the recording paper sheet 1 are in alignment. The thermal head 11 shown in FIG. 1 is then moved forward in the arrow J direction, as shown in FIG. 10C, and the pressure is applied from the thermal head 11 and the platen roller 2 as in the usual printing step under heating at about 70° C. to 120° C. while moving the thermal transfer sheet 5, the surface-property-modifying sheet 8, and the recording paper sheet 1 to conduct surface modification treatment.

Figure 10D:
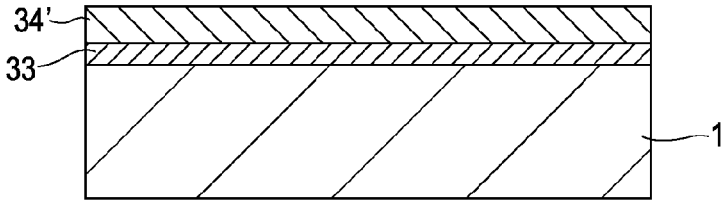

After completion of the surface modification treatment, the thermal transfer sheet 5, the surface-property-modifying sheet 8, and the recording paper sheet 1 move to the downstream side along with the rotation of the platen roller 2 and leave the thermal head 11. The surface-property-modifying sheet 8 after cooling then detaches from the recording paper sheet 1. As a result, as shown in FIG. 10D, a printed image protected with, e.g., a glossy protective layer 34' formed by surface modification of the protective layer 34 shown in FIG. 10A is obtained.

In the description of FIGS. 10A to 10D, the region of the thermal transfer sheet 5 used for the surface modification treatment is the region where the protective material layer 14 use to lie before the transfer operation. However, the region used for the surface modification treatment is not limited to this and may be any one of regions of the yellow, magenta, and cyan dye layers 13*y*, 13*m*, and 13*c* before or after transfer. In the case where any one of regions of the yellow, magenta, and cyan dye layers 13*y*, 13*m*, and 13*c* before or after transfer is used as the region for the surface modification treatment also, the thermal transfer sheet 5 may be backwinded by operating the thermal transfer sheet-moving unit so that the thermal transfer sheet 5 returns to the position before the transfer of the dye layer 13*y*, 13*m*, or 13*c*, i.e., the lead position 18*y*, 18*m*, or 18*c* of the corresponding dye layer. In such a case, the ink remaining on the dye layers 13*y*, 13*m*, or 13*c* will be transferred to the rear side of the surface-property-modifying sheet 8; however, because of the presence of the surface-property-modifying sheet 8, the ink will not be transferred onto the recording paper sheet 1.

Figure 11A:
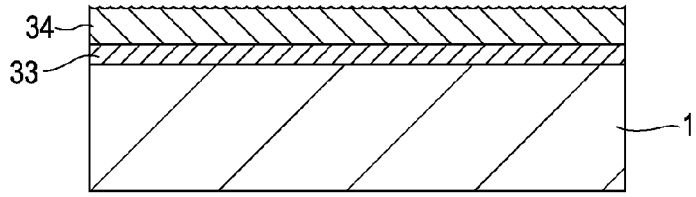
FIGS. 11A to 11D are diagrams showing another example of modifying the surface condition of the protective layer by aligning the protective layer on the image of the recording medium with the surface-property-modifying region of the surface-property-modifying sheet.
Figure 11B:
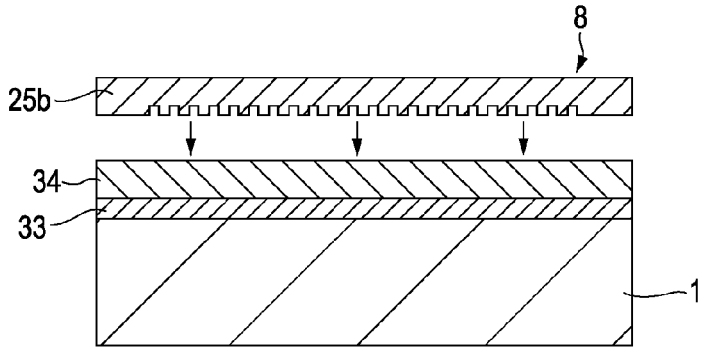

FIGS. 11A to 11D show another embodiment of modifying the surface condition of the protective layer 34 by aligning the protective layer 34 on the image 33 of the recording paper sheet 1 with the position of a surface-property-modifying region of the surface-property-modifying sheet 8. In this embodiment, the surface of the protective layer 34 is matte finished. The step shown in FIG. 11A is identical to the step shown in FIG. 10A. In the step shown in FIG. 11B, the surface-property-modifying region 25*b* for a matte finish is selected from the surface-property-modifying sheet 8 shown in FIG. 3A, for example, and aligned with the position of the protective layer 34 formed on the surface of the image 33 of the recording paper sheet 1. During this step, the position-detecting marks 29, 30*a*, 30*b*, and 30*c* of the surface-property-modifying sheet 8 are detected with the mechanical sensor 31 shown in FIG. 1 to conduct alignment.

Figure 11C:
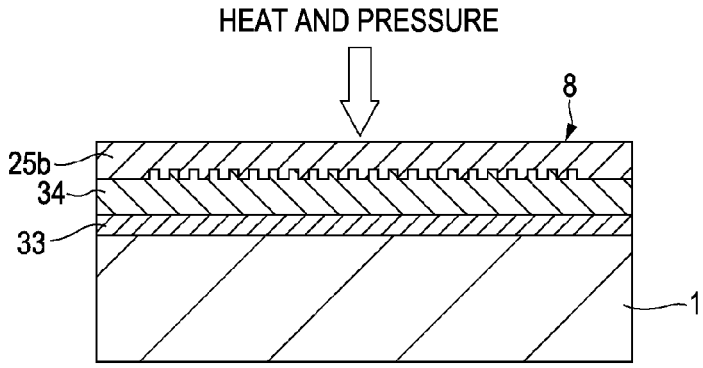

In the next step shown in FIG. 11C, the position of the portion of the thermal transfer sheet 5 where the protective material layer 14 (not shown) used to lie before transfer, the surface-property-modifying region 25*b* of the surface-property-modifying sheet 8, and the position where the protective layer 34 is formed on the image 33 of the recording paper sheet 1 are in alignment. The thermal head 11 shown in FIG. 1 is then moved forward in the arrow J direction, and the pressure is applied from the thermal head 11 and the platen roller 2 as in the usual printing step under heating at about 70° C. to 120° C. while moving the thermal transfer sheet 5, the surface-property-modifying sheet 8, and the recording paper sheet 1 to conduct surface modification treatment.

Figure 11D:
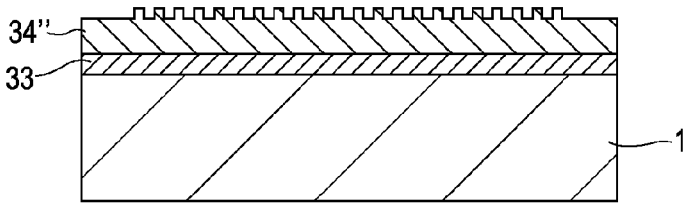

In the step shown in FIG. 11D, after completion of the surface modification treatment, the thermal transfer sheet 5, the surface-property-modifying sheet 8, and the recording paper sheet 1 move to the downstream side along with the rotation of the platen roller 2 and leave the thermal head 11. The surface-property-modifying sheet 8 after cooling then detaches from the recording paper sheet 1. As a result, a printed image protected with, e.g., a matte protective layer 34" formed by surface modification of the protective layer 34 shown in FIG. 11A is obtained.

In the embodiments shown in FIGS. 10A to 11D, one image 33 is printed, and the surface condition of the protective layer 34 protecting the image 33 is modified. Alternatively, a plurality of images 33 may be continuously printed and the surfaces of the protective layers 34 protecting the images 33 may be modified differently depending on the type of finishing desired for each image. For simplicity purposes, the case in which the first printed image is glossy-finished and the second printed image is matte-finished is explained below.

First, steps similar to those shown in FIGS. 10A to 10D are carried out. That is, after the first image 33 and the protective layer 34 have been formed, in continuous operation, the surface of the protective layer 34 is modified using the surface-property-modifying region 25*a* for a glossy finish in the surface-property-modifying sheet 8 to obtain a first image with an improved glossiness.

Next, as with operation during usual continuous printing, the thermal transfer sheet 5 shown in FIGS. 2A and 2B is fed so that the lead position 18*y* of the dye layer 13 in the constitutional unit corresponding to the second image aligns with the recording region of the thermal head 11. The surface-property-modifying sheet 8 is moved so that the opening 24 aligns with the recording region of the thermal head 11. The image 33 and the protective layer 34 are then formed.

At this stage, the tail position 19L (see FIG. 2A) in the thermal transfer sheet 5 after the transfer of the protective material layer 14 aligns with the recording region of the thermal head 11 shown in FIG. 1. Thus, the thermal transfer sheet 5 is backwinded to the original position before transfer of the protective material layer 14, i.e., the lead position 18L, by operating the thermal transfer sheet-moving unit. The surface-property-modifying sheet 8 is moved so that the lead position 27*b* of the surface-property-modifying region 25*b* for a matte finish aligns with the recording region of the thermal head 11. Then as with the first image, the surface of the protective layer 34 is modified using the surface-property-modifying region 25*b* of the surface-property-modifying sheet 8 in continuous operation so as to obtain a matte-finished second image.

According to these image-forming apparatuses and the image-forming methods, it is possible to form the image 33 on the recording paper sheet 1, form the protective layer 34 on the image 33, and modify the surface of the protective layer 34 in one continuous process. Thus, in the case where a plurality of images 33 are continuously printed and various different surface modifications are desired, the surface conditions of the protective layers 34 can be modified differently in one continuous process.

Alternatively, in the embodiments shown in FIGS. 10A to 11D and in the case where a plurality of images 33 are continuously printed and the surface conditions of the protective layers 34 are modified in continuous operation, it is possible to form images 33 and protective layers 34 first and then surface conditions of the protective layers 34 protecting the images 33 may be continuously modified according to the type of finish desired for each printed image.

Figure 12:
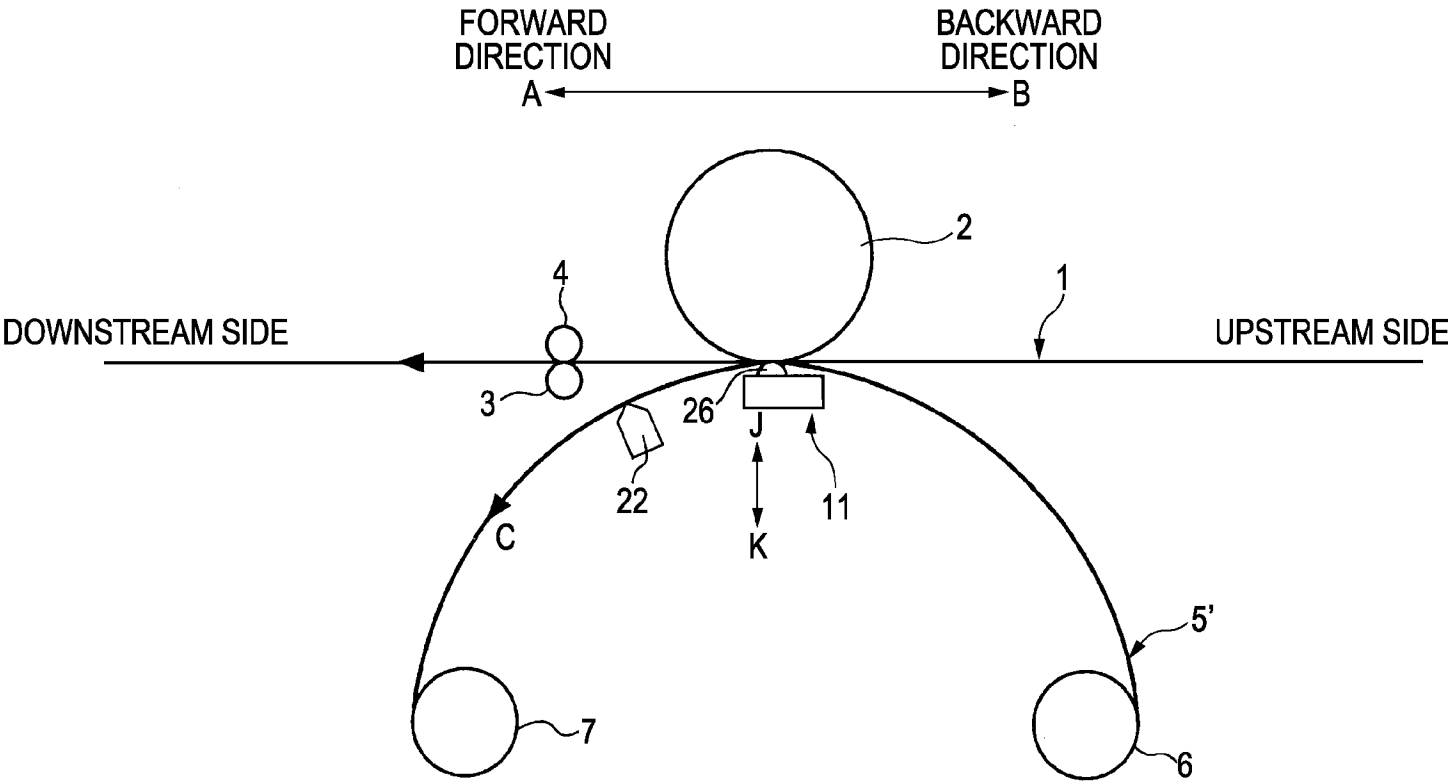
FIG. 12 is a schematic diagram showing a second embodiment of an image-forming apparatus.

FIG. 12 is a schematic view showing an image-forming apparatus according to a second embodiment. The image-forming apparatus of the second embodiment differs from the image-forming apparatus of the first embodiment shown in FIG. 1 in that the surface-property-modifying sheet 8 is not provided between the feed reel 9 and the take-up reel 10. The rest of the structure is basically the same as the first embodiment. Like components are given like reference numerals, and the descriptions thereof are omitted to avoid redundancy.

Figure 13A:
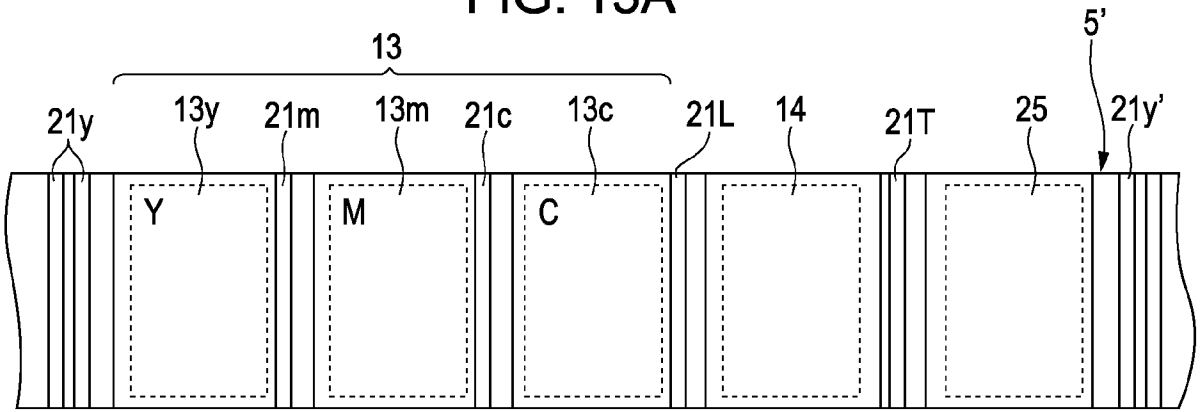
FIG. 13A is a plan view showing an embodiment of a thermal transfer sheet used in the image-forming apparatus of the second embodiment and FIG. 13B is a central vertical cross-sectional view of the thermal transfer sheet in FIG. 13A.
Figure 13B:
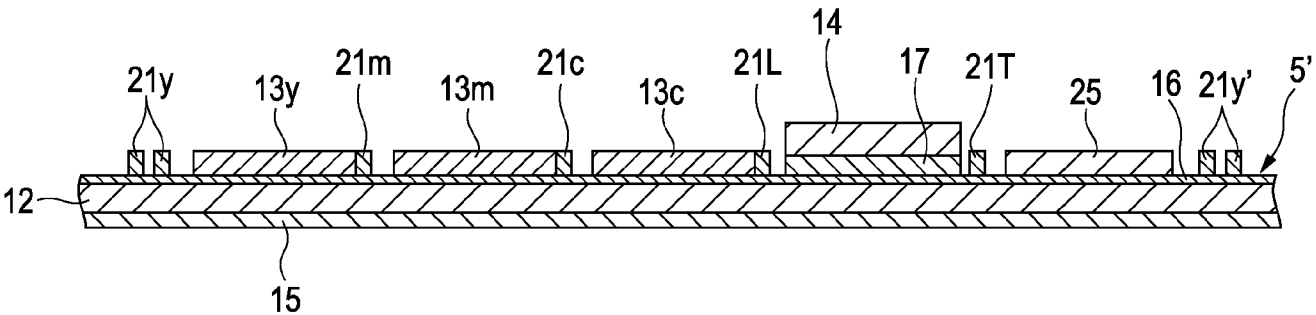

The image-forming apparatus of the second embodiment does not have surface-property-modifying sheet 8 but has a thermal transfer sheet 5' stretched between the feed reel 6 and the take-up reel 7. The thermal transfer sheet 5' of the second embodiment differs from the thermal transfer sheet 5 of the first embodiment shown in FIG. 1. For example, as shown in FIGS. 13A and 13B, the dye layer 13 of one or more colors for forming an image on the surface of the recording paper sheet 1 by thermal transfer, the protective material layer 14 to be thermally transferred to the surface of the image formed on the recording paper sheet 1 so as to protect the image, and a surface-property-modifying region 25 for modifying the surface conditions of the protective layer protecting the image on the recording paper sheet 1 are arranged side-by-side on the ribbon-shaped substrate sheet 12 in the longitudinal direction of the substrate sheet 12. The thermal transfer sheet 5' differs from the thermal transfer sheet 5 shown in FIG. 2A in that the surface-property-modifying region 25 is formed on the thermal transfer sheet 5' along with the dye layer 13 and the protective material layer 14.

The thermal transfer sheet 5' of this embodiment has the surface-property-modifying sheet 8 shown in FIG. 1 integrated in the thermal transfer sheet. Since the modifying sheet-moving unit constituted by the feed reel 9 and the take-up reel 10 to move the surface-property-modifying sheet 8 is not needed, the structure can be simplified and the size of the apparatus can be reduced.

FIG. 13A shows one constitutional unit of the thermal transfer sheet 5' for forming one printed image. A plurality of such constitutional units are repeatedly formed in the longitudinal direction of the thermal transfer sheet 5' so that a plurality of printed images can be formed. In this embodiment, a polyimide such as Upilex S (Ube Industries Ltd.) is used in the surface-property-modifying region 25. In particular, a polyimide film is bonded on the substrate sheet 12 through the adhesive layer 16 and a bonding layer (not shown) to form the surface-property-modifying region 25. In FIGS. 13A and 13B, reference numeral 21T denotes a surface property modifying position-detecting mark provided near the surface-property-modifying region 25 to indicate the position of the surface-property-modifying region 25. The adhesive layer 16 is not necessarily provided.

The surface-property-modifying region 25 is not limited to one prepared by bonding of a polyimide film. For example, various films made of various highly heat resistant materials formed by physical vapor deposition such as sputtering, ion plating, vapor deposition, or the like may be used as the surface-property-modifying region 25. Furthermore, the surface-property-modifying region 25 may be made by application and heat treatment of a material such as a siloxane-modified polyimide film (heat resistant bonding materials UPA Series produced by Ube Industries Ltd). In the case where a siloxane-modified polyimide film is used, superior releasing property is exhibited due to siloxane modification. Thus, detachment between the surface-property-modifying region 25 after the surface modification treatment and the protective layer on the printed image can be stably carried out.

Since a siloxane-modified polyimide film can satisfactorily adhere to a polyimide film, the releasing property can also be enhanced by using a polyimide film coated with a siloxane-modified polyimide thin film as the surface-property-modifying region 25. The same applies to the surface-property-modifying region 25 of other embodiments.

For simplicity purposes, FIGS. 13A and 13B show only one type of surface-property-modifying region 25; however, as in the embodiments shown in FIGS. 3A and 7A, the surface-property-modifying regions 25*a*, 25*b*, and 25*c* for glossy, matte, and embossed finish, respectively, and other desirable modifying regions may be provided depending on the type of surface modification desired. In the case where glossy finish is desired, the surface of the Upilex S (trade name, product of Ube Industries Ltd.) is directly used as the surface that comes into contact with the recording paper sheet 1. In the case where matte or embossed finish is desired, a PET film having a surface pattern intentionally formed by mixing a filler into the film or a film having a surface pattern made by surface treatment using the die member 32 such as an embossing roller may be bonded on the substrate sheet so that the surface that comes into contact with the recording paper sheet 1 has irregularities.

A method for forming an image using the image-forming apparatus of the second embodiment having the above-described structure will now be described. The image-forming method of this embodiment is different from the image-forming method of the first embodiment that uses the image-forming apparatus of the first embodiment in that there is no step for moving the surface-property-modifying sheet 8.

In other words, the method includes a step of conveying the recording paper sheet 1 in a predetermined direction; a step of moving in a predetermined direction the thermal transfer sheet 5' having the dye layer 13, the protective material layer 14, and the surface-property-modifying region 25 arranged side-by-side on the substrate sheet 12 in the longitudinal direction of the substrate sheet 12; a step of applying thermal energy from the thermal head 11 so as to thermally transfer the dye layer 13 on the thermal transfer sheet 5' onto the surface of the recording paper sheet 1 so as to form an image on the recording paper sheet 1; a step of thermally transferring the protective material layer 14 on the thermal transfer sheet 5' onto the image formed on the recording paper sheet 1; and a step of aligning the protective layer formed on the image on the recording paper sheet 1 with the position of the surface-property-modifying region 25 in the thermal transfer sheet 5', applying heat and pressure with the thermal head 11, and detaching the thermal transfer sheet 5' after cooling so as to modify the surface conditions of the protective layer.

Referring to FIG. 12, in the above-described process, as in usual printing, the thermal head 11 may be moved forward in the arrow J direction while the recording paper sheet 1 is being superimposed on the thermal transfer sheet 5' so that the thermal transfer sheet 5' is pushed upward from the rear side to apply thermal energy from the thermal head 11 while the thermal head 11 is pressed against the platen roller 2. As a result, an image can be formed on the recording paper sheet 1, the protective layer can be formed on the image, and the surface conditions of the protective layer can be modified all by using the thermal transfer sheet 5.

Figure 14A:
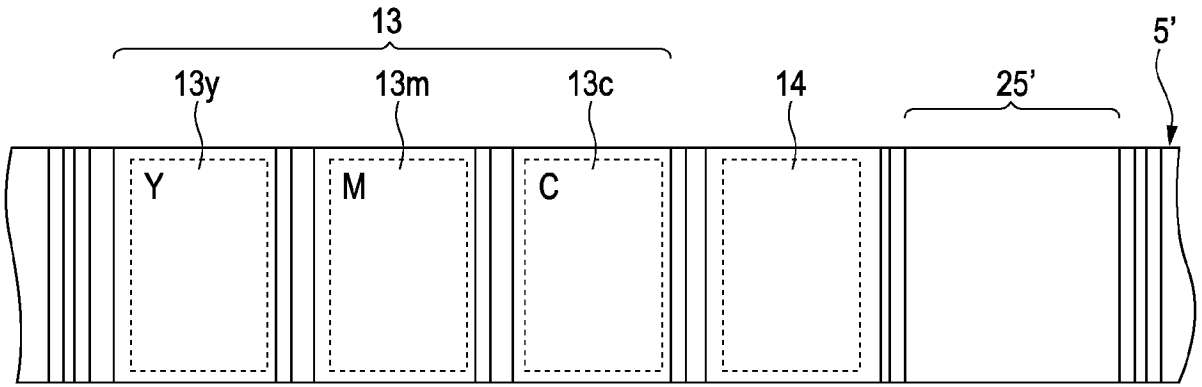
FIG. 14A is a plan view showing another example of the thermal transfer sheet and FIG. 14B is a central vertical cross-sectional view of the thermal transfer sheet in FIG. 14A.
Figure 14B:
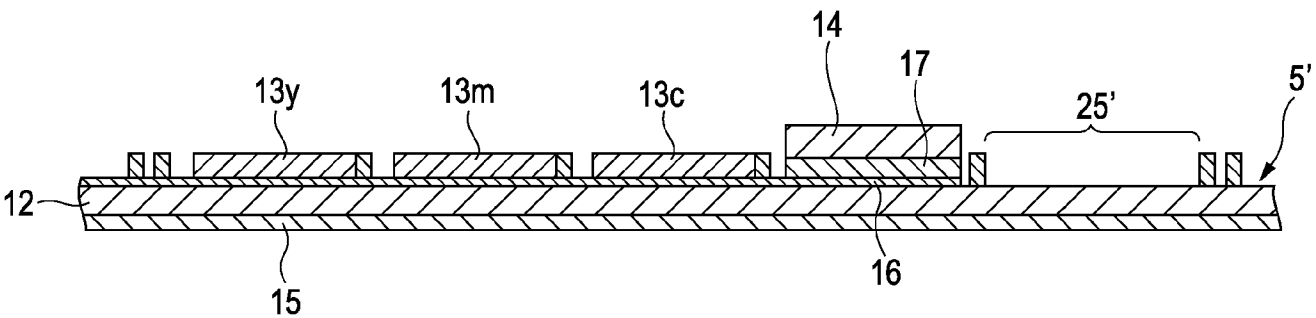

FIGS. 14A and 14B are diagrams showing another embodiment of the thermal transfer sheet 5'. In this embodiment, a surface-property-modifying region 25' is formed by exposing the corresponding part of the substrate sheet 12. The rest of is the same as the thermal transfer sheet 5' shown in FIGS. 13A and 13B. Since the exposed part of the substrate sheet 12 functions as the surface-property-modifying region 25', the reverse of the surface conditions of the PET film constituting the substrate sheet 12 is transferred to the surface of the protective layer on the image on the recording paper sheet 1, and a printed image with modified surface conditions is obtained. According to this embodiment, no special components for forming the surface-property-modifying region 25' are necessary and thus this embodiment is advantageous in production cost.

If the surface-property-modifying region 25' is used for a glossy finish, the exposed part of the substrate sheet 12 is directly used as the surface-property-modifying region 25'. If a matte or embossed finish is desired, the exposed portion of the substrate sheet 12 may be rendered asperities by, for example, thermal transfer using a die member having corresponding asperities.

The surface-property-modifying region 25' may be subjected to a releasing treatment such as forming of a releasing layer on the surface of the surface-property-modifying region 25' so that the detachability between the surface-modified thermal transfer sheet 5' and the recording paper sheet 1 can be satisfactorily stabilized. Examples of the material usable in the releasing treatment include a thin layer of the siloxane-modified polyimide described above. Moreover, various fluoroalkylsilanes such as KP-801M (trade name, product of Shin-Etsu Chemical Co., Ltd.) and fluorine-based coating agents such as Cytop (trade name, product of Asahi Glass Co., Ltd.) may be used to form the releasing layer. In the case where a releasing layer is made using a fluoroalkylsilane or a fluorine-based coating agent such as Cytop, an extremely thin film can be produced. Moreover, since fluoroalkylsilane and the fluorine-based coating agent are transparent in the visible light range, inspection during production of the thermal transfer sheet 5' integrated with the surface-property-modifying sheet 8 and detection of the position of the surface-property-modifying region 25' during printing or during surface property modification treatment can be smoothly carried out without trouble.

Figure 15A:
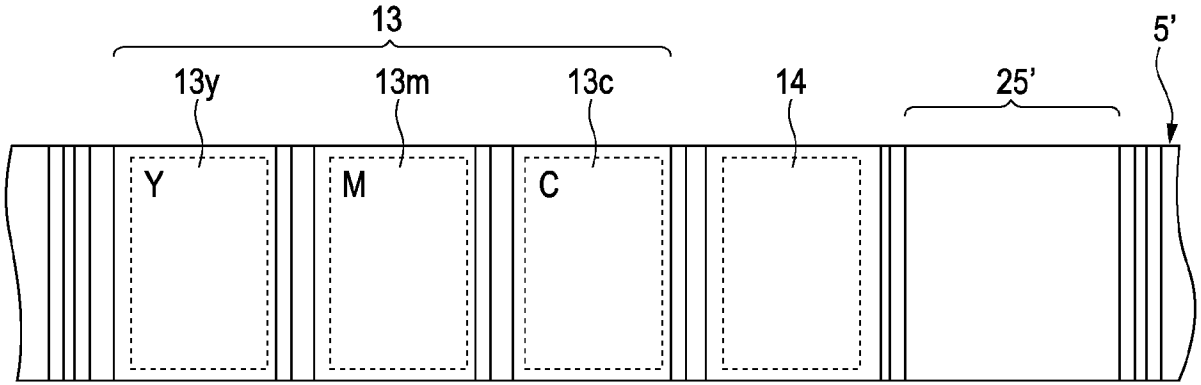
FIG. 15A is a plan view showing yet another example of the thermal transfer sheet and FIG. 15B is a central vertical cross-sectional view of the thermal transfer sheet in FIG. 15A.
Figure 15B:
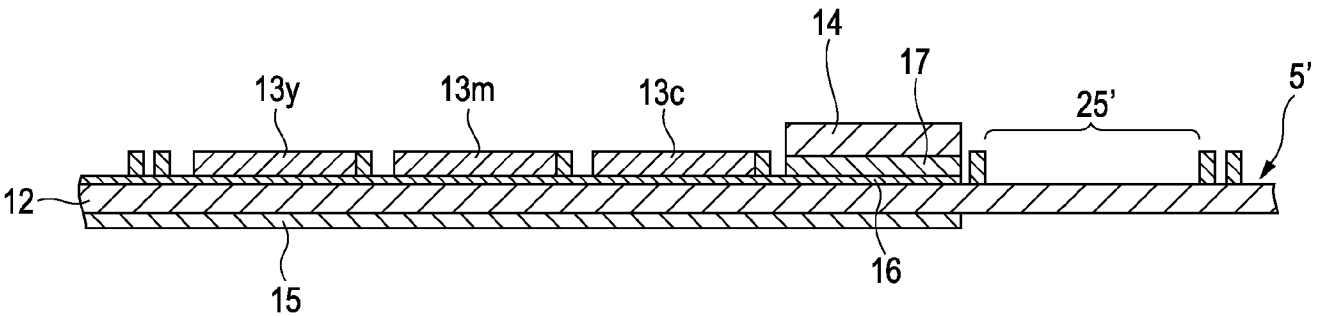

FIGS. 15A and 15B show yet another embodiment of the thermal transfer sheet 5'. In this embodiment, unlike the thermal transfer sheet 5' shown in FIGS. 14A and 14B, the thermal transfer sheet 5' shown in FIGS. 15A and 15B has the heat-resistant lubricating layer 15 partly removed from the portion of the rear side of the substrate sheet 12 corresponding to the surface-property-modifying region 25'. The rest of the structure is the same as that shown in FIGS. 14A and 14B. The heat-resistant lubricating layer 15 is partly removed because the heat-resistant lubricating layer 15 has lower surface smoothness than the substrate sheet 12. As a result, especially when surface modification treatment is performed to enhance glossiness, an excellent glossy-finished printed image can be obtained.

Although dye-sublimation-type thermal printers are described as examples of the image-forming apparatus, the present invention is not limited to dye-sublimation-type thermal printers and can be applied to fusion transfer thermal printers. The present invention is also applicable to modification of the surface conditions of the printed images formed on a thermosensitive recording paper sheet with a thermographic printers.

It should be understood by those skilled in the art that various modifications, combinations, sub-combinations and alterations may occur depending on design requirements and other factors insofar as they are within the scope of the appended claims or the equivalents thereof.

What is claimed is:

1. A method to form an image comprising the steps of:

(a) conveying a recording medium in one direction;

(b) moving a thermal transfer sheet in the one direction, the thermal transfer sheet including a first ribbon-shaped substrate sheet, a dye layer operable to form an image when thermally transferred onto a surface of the recording medium, and a protective material layer operable to form a protective layer to protect the image when thermally transferred onto the surface of the image formed on the surface of the recording medium, the dye layer and the protective material layer arranged side-by-side on the first ribbon-shaped substrate sheet in a longitudinal direction of the first ribbon-shaped substrate sheet;

(c) applying thermal energy by using a thermal head while arranging the recording medium to face the dye layer of the thermal transfer sheet so as to thermally transfer the dye layer of the thermal transfer sheet onto the surface of the recording medium to form an image;

(d) applying thermal energy by using the thermal head while arranging the image formed on the recording medium to face the protective material layer of the thermal transfer sheet so as to thermally transfer the protective material layer of the thermal transfer sheet onto the image formed on the recording medium and to form a protective layer on the image;

(e) moving a surface-property-modifying sheet including a second ribbon-shaped substrate sheet and a surface-property-modifying region operable to modify a surface condition of the protective layer protecting the image formed on the recording medium, the surface-property-modifying region arranged on the second ribbon-shaped substrate sheet in the longitudinal direction of the second ribbon-shaped substrate sheet; and (f) aligning the protective layer formed on the image on the recording medium with the surface-property-modifying region of the surface-property-modifying sheet, applying heat and pressure by using the thermal head, and detaching the surface-property-modifying sheet after cooling so as to modify the surface condition of the protective layer, wherein the surface-property-modifying sheet has an opening for printing so that the thermal transfer sheet is operable to directly contact the surface of the recording medium through the opening.

2. The method according to claim 1, wherein the opening is aligned with the thermal head so that the thermal transfer sheet directly contacts the recording medium through the opening to form the image.

3. The method according to claim 1, wherein, in heating the surface-property-modifying region of the surface-property-modifying sheet by using the thermal head, heating is performed at a temperature near a glass transition temperature of the protective material layer of the thermal transfer sheet.

4. The method according to claim 1, wherein modification of the surface condition of the protective layer formed on the image on the recording medium involves imparting glossiness to the surface of the protective layer.

5. The method according to claim 1, wherein modification of the surface condition of the protective layer formed on the image on the recording medium involves imparting a matte or embossed texture to the surface of the protective layer.

6. A thermal transfer sheet comprising:

a ribbon-shaped substrate sheet;

a dye layer operable to form an image when thermally transferred onto a surface of a recording medium used in an image-forming apparatus;

a protective material layer operable to form a protective layer protecting the image when thermally transferred onto a surface of the image formed on the surface of the recording medium; and a surface property modifying sheet having a surface-property-modifying region of at least one type operable to modify a surface condition of the protective layer, wherein, the dye layer, the protective material layer, and the surface-property-modifying region are arranged side-by-side on the ribbon-shaped substrate sheet, and the surface property modifying sheet has an opening to allow the thermal transfer sheet to directly contact the surface of the recording medium through the opening.

7. The thermal transfer sheet according to claim 6, wherein the dye layer has one or more colors, the dye layer, the protective material layer, and the surface-property-modifying region are sequentially formed on the ribbon-shaped substrate sheet, and a position detecting mark is provided near each of the dye layer, the protective material layer, and the surface-property-modifying region.

8. The thermal transfer sheet according to claim 6, wherein the surface-property-modifying region is an exposed portion of the ribbon-shaped substrate sheet.

9. The thermal transfer sheet according to claim 6, wherein the surface-property-modifying region imparts glossiness to the surface of the protective layer protecting the image formed on the recording medium.

10. The thermal transfer sheet according to claim 6, wherein the surface-property-modifying region imparts a matte or embossed texture to the surface of the protective layer protecting the image on the recording medium.

* * * * *